US008782922B2

(12) United States Patent
May et al.

(10) Patent No.: US 8,782,922 B2
(45) Date of Patent: Jul. 22, 2014

(54) DRYER MONITORING

(75) Inventors: Robert E. May, Lakeville, MN (US); Julio R. Panama, Blaine, MN (US); Nicholas D. Parent, Saint Paul, MN (US); Mihnea A. Popa, Inver Grove Heights, MN (US); Bruce W. Weber, Stillwater, MN (US)

(73) Assignee: Ecolab USA Inc., St. Paul, MN (US)

( * ) Notice: Subject to any disclaimer, the term of this patent is extended or adjusted under 35 U.S.C. 154(b) by 810 days.

(21) Appl. No.: 12/954,006

(22) Filed: Nov. 24, 2010

(65) Prior Publication Data

US 2012/0124859 A1 May 24, 2012

(51) Int. Cl.

| | |
|---|---|
| ***F26B 3/00*** | (2006.01) |
| ***F26B 19/00*** | (2006.01) |
| ***G06F 11/00*** | (2006.01) |

(52) U.S. Cl.

USPC ..... 34/491; 34/493; 34/572; 702/188

(58) Field of Classification Search

USPC ..... 34/491, 446, 493, 524, 572; 702/130, 702/188, 136; 340/870.08

See application file for complete search history.

(56) References Cited

U.S. PATENT DOCUMENTS

| | | | | |
|---|---|---|---|---|
| 2,717,455 | A * | 9/1955 | Harris et al. | 34/543 |
| 3,510,957 | A | 5/1970 | Jarvis | |
| 3,870,145 | A | 3/1975 | Mizuno | |
| 4,019,259 | A | 4/1977 | Veraart | |
| 4,385,452 | A | 5/1983 | Deschaaf et al. | |
| 4,481,786 | A | 11/1984 | Bashark | |
| 4,549,362 | A | 10/1985 | Haried | |
| 4,763,425 | A | 8/1988 | Grennan | |
| 4,827,627 | A | 5/1989 | Cardoso | |
| 5,050,313 | A | 9/1991 | Wakaeya et al. | |
| 5,166,592 | A | 11/1992 | Bashark | |
| 5,193,292 | A | 3/1993 | Hart et al. | |
| 5,281,956 | A | 1/1994 | Bashark | |
| 5,347,727 | A | 9/1994 | Kim | |
| 5,412,291 | A | 5/1995 | Payne et al. | |
| 5,560,124 | A | 10/1996 | Hart et al. | |

(Continued)

FOREIGN PATENT DOCUMENTS

| | | |
|---|---|---|
| DE | 19611324 A1 | 10/1996 |
| DE | 19611324 C2 | 2/1999 |

(Continued)

OTHER PUBLICATIONS

International Search Report and Written Opinion for corresponding international application No. PCT/IB2011\054910, dated Aug. 28, 2012, 9 pp.

(Continued)

*Primary Examiner* — Kenneth Rinehart
*Assistant Examiner* — John McCormack
(74) *Attorney, Agent, or Firm* — Shumaker & Sieffert, P.A.

(57) ABSTRACT

A dryer monitoring system receives dryer information from one or more sensors concerning operation of one or more dryers, such as clothes dryers. For example, the dryer monitoring system may receive temperature, humidity, and/or dryer on/off information concerning the dryers. The dryer monitoring system may analyze the dryer information and generate reports communicating the dryer information, identify possible maintenance issues with the dryers, identify ambient environmental conditions that may lead to inefficient drying, identify possible operator errors, and/or diagnose other dryer conditions that may be determined based on the dryer information.

15 Claims, 18 Drawing Sheets

(56) References Cited

U.S. PATENT DOCUMENTS

| | | | | |
|---|---|---|---|---|
| 5,675,911 | A | 10/1997 | Moser | |
| 5,682,684 | A | 11/1997 | Wentzlaff et al. | |
| 5,852,881 | A | 12/1998 | Kuroda et al. | |
| 6,061,668 | A | 5/2000 | Sharrow | |
| 6,104,987 | A * | 8/2000 | Farnsworth | 702/130 |
| 6,122,840 | A | 9/2000 | Chbat et al. | |
| 6,446,357 | B2 | 9/2002 | Woerdehoff et al. | |
| 6,484,417 | B2 | 11/2002 | Tedman et al. | |
| 6,493,963 | B1 | 12/2002 | England | |
| 6,519,871 | B2 | 2/2003 | Gardner et al. | |
| 6,745,496 | B2 | 6/2004 | Cassella | |
| 6,779,740 | B1 | 8/2004 | Lentsch et al. | |
| 6,845,290 | B1 | 1/2005 | Wunderlin et al. | |
| 6,910,640 | B2 | 6/2005 | Griese et al. | |
| 6,931,759 | B2 | 8/2005 | Jeong et al. | |
| 6,931,760 | B2 | 8/2005 | Yang | |
| 6,968,632 | B2 | 11/2005 | Guinibert et al. | |
| 6,988,375 | B2 | 1/2006 | Bashark | |
| 7,313,874 | B2 * | 1/2008 | Park | 34/493 |
| 7,412,783 | B2 | 8/2008 | Guinibert et al. | |
| 7,478,486 | B2 | 1/2009 | Wunderlin et al. | |
| 7,526,956 | B2 | 5/2009 | Muzzolini | |
| 7,594,343 | B2 | 9/2009 | Woerdehoff et al. | |
| 2002/0174564 | A1 | 11/2002 | England | |
| 2003/0034443 | A1 | 2/2003 | Kouznetsov et al. | |
| 2003/0195130 | A1 | 10/2003 | Lentsch et al. | |
| 2004/0123486 | A1 | 7/2004 | Hameed et al. | |
| 2004/0168343 | A1 | 9/2004 | Park | |
| 2005/0066999 | A1 | 3/2005 | Dietz et al. | |
| 2005/0091875 | A1 | 5/2005 | Kim | |
| 2005/0091876 | A1 | 5/2005 | Yang | |
| 2005/0183209 | A1 | 8/2005 | Costa et al. | |
| 2006/0191161 | A1 | 8/2006 | Wunderlin et al. | |
| 2007/0256321 | A1 | 11/2007 | Bae et al. | |
| 2008/0072448 | A1 * | 3/2008 | Hubig et al. | 34/446 |
| 2008/0104860 | A1 | 5/2008 | Muenzner et al. | |
| 2008/0184588 | A1 | 8/2008 | Somod et al. | |
| 2008/0264111 | A1 | 10/2008 | Giordano | |
| 2009/0126220 | A1 | 5/2009 | Nawrot et al. | |

FOREIGN PATENT DOCUMENTS

| | | | |
|---|---|---|---|
| EP | 0 709 516 | A1 | 5/1996 |
| EP | 0 709 516 | B1 | 5/1996 |
| EP | 0 816 551 | A2 | 1/1998 |
| EP | 0 863 244 | A2 | 9/1998 |
| JP | 4039000 | A | 2/1992 |
| JP | 4109999 | A | 4/1992 |
| JP | 4-285599 | A | 10/1992 |
| JP | 5115688 | A | 5/1993 |
| JP | 10043498 | | 2/1998 |
| JP | 10197152 | A | 7/1998 |
| JP | 11235499 | A | 8/1999 |
| JP | 2001194067 | A | 7/2001 |
| JP | 2004321766 | A | 11/2004 |
| JP | 2008194153 | A | 8/2008 |
| KR | 2002-0076590 | A | 10/2002 |
| KR | 2004-0110812 | A | 12/2004 |
| WO | WO 2008049534 | A1 | 5/2008 |

OTHER PUBLICATIONS

Examiner's Answer to Appeal Brief for U.S. Appl. No. 11/526,515, dated Jan. 24, 2012, 37 pp.

Reply Brief to Examiner's Answer, dated Jan. 24, 2012, for U.S. Appl. No. 11/526,515, filed Mar. 23, 2012, 12 pp.

Office Action from U.S. Appl. No. 11/526,515, dated Jul. 11, 2011, 17 pp.

U.S. Appl. No. 13/273,805, filed Oct. 14, 2011, entitled, "Dryer Monitoring".

Genskow et al., "Psychrometry, Evaporative Cooling, and Solids Drying," Perry's Chemical Engineers' Handbook, Eighth Edition, Section 12, Oct. 26, 2007, pp. 12-1, 12-5, 12-14.

Karmakar et al., "Novel Feature for Quantifying Temporal Variability of Poincare Plot: A Case Study," Computers in Cardiology 2009;36:53-56.

Koebbe et al., "Use of Recurrence Plots in the Analysis of Time-Series Data," University of California—Santa Cruz; Rush—Pres.—St. Luke's Medical Center, Chicago, IL Sep. 29, 1994, 7 pp.

* cited by examiner

702

| TOTAL DRYER CYCLES | | | | | | | | | | |
|---|---|---|---|---|---|---|---|---|---|---|
| | CURRENT | P2 | P3 | P4 | P5 | P6 | | | | |
| DRYER #1 | * 60 | 80 | 60 | 60 | 60 | 60 | * = + OR - 20% FROM 3 MONTH TREND | | | |
| DRYER #2 | | | | | | | | | | |
| DRYER #3 | | | | | | | | | | |
| DRYER #4 | | | | | | | | | | |

Fig. 15A

704

| TOTAL DRYER CYCLES | | | | | | | | | | |
|---|---|---|---|---|---|---|---|---|---|---|
| | CURRENT | P2 | P3 | P4 | P5 | P6 | | | | |
| DRYER #1 | * 60 | 80 | 60 | 60 | 60 | 60 | * = + OR - 20% FROM 3 MONTH TREND | | | |
| DRYER #2 | | | | | | | | | | |
| DRYER #3 | | | | | | | | | | |
| DRYER #4 | | | | | | | | | | |

Fig. 15B

706

| AVERAGE DRY TIME PER LOAD | | | | | | | | | | |
|---|---|---|---|---|---|---|---|---|---|---|
| | CURRENT | P2 | P3 | P4 | P5 | P6 | | | | |
| DRYER #1 | | | | | | | * = + OR - 20% FROM 3 MONTH TREND | | | |
| DRYER #2 | | | | | | | | | | |
| DRYER #3 | | | | | | | | | | |
| DRYER #4 | | | | | | | | | | |
| | CHECK THE LINT SCREEN. DOES THE CUSTOMER NEED TRAINING ON CLEANING PROCEDURES? | | | | | | | | | |
| | CHECK THE BURNER TO SEE IF IT IS OPERATIING PROPERLY (IS THERE A BLUE FLAME?) | | | | | | | | | |
| | IS THE WASHER EXTRACTING EFFICIENTLY? | | | | | | | | | |

Fig. 15C

708

| TOTAL OVER DRY TIME | | | | | | | | | | |
|---|---|---|---|---|---|---|---|---|---|---|
| | CURRENT | P2 | P3 | P4 | P5 | P6 | | | | |
| DRYER #1 | | | | | | 60 | * = + OR - 20% FROM 3 MONTH TREND | | | |
| DRYER #2 | | | | | | | | | | |
| DRYER #3 | | | | | | | | | | |
| DRYER #4 | | | | | | | | | | |
| | TRAIN CUSTOMER TO SHUT OFF THE DRYER WHEN IT ALARMS | | | | | | | | | |

Fig. 15D

710

| AVERAGE HIGH TEMPERATURE/DRYER | | | | | | | | | | |
|---|---|---|---|---|---|---|---|---|---|---|
| | CURRENT | P2 | P3 | P4 | P5 | P6 | | | | |
| DRYER #1 | | | | | | 60 | * = + OR - 20% FROM 3 MONTH TREND | | | |
| DRYER #2 | | | | | | | | | | |
| DRYER #3 | | | | | | | | | | |
| DRYER #4 | | | | | | | | | | |
| | CHECK THE BURNER TO SEE IF IT IS OPERATING PROPERLY (IS THERE A BLUE FLAME?) | | | | | | | | | |
| | CAN THE DRYER TEMPERATURE BE ADJUSTED? | | | | | | | | | |
| | HAVE THE CUSTOMER REQUEST MAINTENANCE SERVICE FROM THE DRYER DISTRIBUTOR | | | | | | | | | |

Fig. 15E

712

| AVERAGE LOW HUMIDITY DRYER | | | | | | | | | | |
|---|---|---|---|---|---|---|---|---|---|---|
| | 4/26/2010 | 3/27/2010 | 2/25/2010 | 1/26/2010 | 12/27/2009 | 11/27/2009 | | | | |
| | 5/25/2010 | 4/25/2010 | 4/25/2010 | 2/24/2010 | 1/25/2010 | 12/26/2009 | | | | |
| DRYER #1 | | | | | | | * = + OR - 20% FROM 3 MONTH TREND | | | |
| DRYER #2 | | | | | | | | | | |
| DRYER #3 | | | | | | | | | | |
| DRYER #4 | | | | | | | | | | |

Fig. 15F

DRYER MONITORING

TECHNICAL FIELD

The disclosure relates to monitoring of dryers.

BACKGROUND

Conventional clothes dryers include a rotating drum into which textiles to be dried are placed. The textiles are dried by forcing heated air through the wet laundry rotating within the drum. Moisture is removed along with the air exiting the dryer or via a condensed water duct.

Conventional clothes dryers have been controlled in various ways. The simplest of these is a timer that controls the duration of the drying cycle. When using a timer, the user places wet laundry inside the dryer and selects the duration for the drying cycle. The dryer cycle then proceeds until the timer expires. Although this method is relatively simple, it is difficult to accurately estimate the length of time required to reach a desired final moisture level, or "dryness," for every type of textile. If the cycle length is too short, the textiles will not be fully dry at the end of the cycle, and the user must initiate another dryer cycle to finish the drying process. If, on the other hand, the cycle length is too long, the clothes may become "overdry," which may result in premature textile degradation and/or damage, excess energy consumption, and an associated increase in energy costs.

SUMMARY

In general, the disclosure is related to a dryer monitor system that monitors and/or analyzes one or more dryer performance parameters. The dryer performance parameters may include the total number of dryer cycles per dryer, the total number of overdry cycles, the average dry time per load, the total overdry time, the average high/temperature per dryer, the average low humidity per dryer, and other parameters related to the effectiveness and/or efficiency of one or more dryers at a laundry location or group of laundry location. A system that analyzes the dryer performance parameters may generate reports of the data gathered by one or more dryer monitors and may generate diagnostic suggestions if certain parameters exceed set thresholds.

In one example, the disclosure is directed to a system comprising a plurality of clothes dryers, a plurality of sensors, each of which detects dryer information associated with at least one of the plurality of clothes dryers, and a controller that receives the dryer information, the controller further including an analysis application that analyzes the dryer information and generates one or more dryer status conclusions based on the analysis, and a reporting application that generates reports based on the analysis.

In another example, the disclosure is directed to a system comprising a controller that receives dryer on/off information indicative of whether a clothes dryer is on and that receives temperature information indicative of an operating temperature of the clothes dryer, and a memory that stores at least one dryer on/off threshold and at least one temperature threshold, wherein the controller further analyzes the dryer on/off information and the temperature information in combination with the at least one dryer on/off threshold and the at least one temperature threshold and identifies a dryer status conclusion based on the analysis.

In another example, the disclosure is directed to a system comprising a plurality of dryer installations, each dryer installation including one or more clothes dryers, a plurality of sensors, each of which detects dryer information associated with one of the clothes dryers at the dryer installations, and a central computer that receives the dryer information, the controller further including an analysis application that analyzes the dryer information and generates one or more dryer status conclusions based on the analysis, and a reporting application that generates reports based on the analysis.

The details of one or more examples are set forth in the accompanying drawings and the description below. Other features will be apparent from the description and drawings, and from the claims.

BRIEF DESCRIPTION OF DRAWINGS

FIGS. 15A-15F illustrate example reports that may be generated by the dryer monitor 20 or reporting application 634.

DETAILED DESCRIPTION

Figure 1:
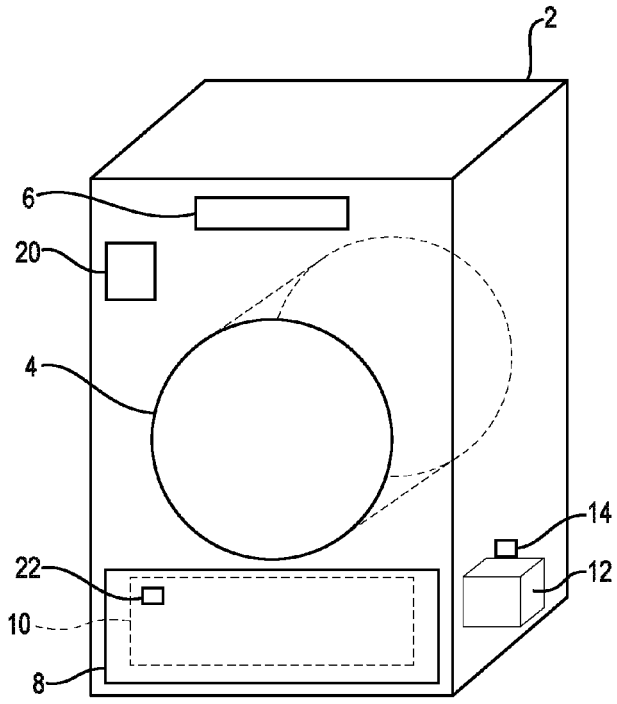
FIG. 1 is a block diagram illustrating an example of a dryer monitor mounted on a clothes dryer.

FIG. 1 is a diagram illustrating an example of a clothes dryer 2 and a dryer monitor 20. Although in FIG. 1 dryer monitor 20 is shown mounted to the front of dryer 2, it shall be understood that the dryer monitor 20 may be positioned at some other location, such as any other location on dryer 2, on a wall, in a central control area or at any other designated location. Dryer 2 includes a rotatable drum 4 in which textiles to be dried are placed. A dryer control panel 6 includes the various dials, knobs, indicia and other elements through which a user controls operation of dryer 2. Control panel 6 may include any of the known conventional dryer controls, such as a start/stop button, a timed dry dial, a heat level selector (e.g., high, medium, low, none) and/or a fabric-type selector (e.g., heavy duty, regular, delicate). One or more sensors 22 sense one or more types of dryer information related to the operation and/or status of the dryer. Sensors 22 may include, for example, temperature sensors, humidity sensors, moisture content sensors, dryer on/off sensors, timers, or other sensors that detect data concerning operations of or conditions of or within dryer 2. The dryer information sensed may include temperature information, humidity information, moisture content information, dryer on/off information, date/time information, cycle count information, or other information related to the performance and/or status of a dryer.

Sensors 22 may be located at any appropriate position with respect to the dryer where it is convenient or where it is best suited to measure the dryer information at issue. For example, sensors 22 may be located either inside and/or outside the drying compartment of the dryer. In the case of the clothes dryer 2 as shown in FIG. 1, sensors 22 may be located outside drum 4 of dryer 2. Dryer 2 may include an exhaust compartment 8 having a lint filter 10 located therein. Sensors 22 may also be placed within the exhaust compartment 8. The sensors may be placed on the outbound side of lint filter 10 to help ensure that lint from the dryer does not interfere with operation of sensors 22, or may be on the inside of the lint filter if that position is more conducive to obtaining the desired dryer information. Dryer 2 also includes one or more motors, indicated generally by reference numeral 12, that drive various dryer parts such as rotatable drum 4 and/or a blower/fan during a drying cycle.

Dryer monitor 2 may also receive information from a dryer on/off sensor 14. Dryer on/off sensor 14 may detect, for example, the start of a dryer cycle, the stop of a dryer cycle, or whether the dryer is currently on and/or off. Dryer on/off sensor 14 may be implemented, for example, using an inductive sensor, magnetic sensor, or other proximity sensor capable of detecting whether dryer motor 12 is running. Alternatively, dryer on/off sensor 14 may be hardwired to the motor to electrically detect when the motor is running. Alternatively, dryer on/off sensor 14 may be implemented using a sensor that senses air flow through the dryer, such as a differential pressure sensor, a sail switch, a vane switch or a flow switch or other switch that is switched on or off in response to the flow or non-flow of air, or other sensor capable of detecting air flow. Dryer sensor 14 may also be implemented using a temperature sensor that senses temperature changes indicative of dryer on/off status, a current sensor that senses current to the motor/fan, or any other device or sensor that may also be used to detect when the dryer is on and/or off. Depending upon the type of dryer on/off sensor used, the sensor 14 may be placed on or near the dryer motor, on or near the motor relay, on or near the fan relay, in or near the exhaust vent of the dryer, in the drum of the dryer, or other suitable position in which the dryer on/off sensor may detect the on/off status of the dryer.

In some examples, a sensor such as sensor 14 senses only the start and/or stop points of a dry cycle. In other examples, a sensor such as sensor 14 may sense the start point, stop point, and/or continuously sense whether the dryer is on and/or off throughout a dryer cycle.

In individual homes as well as in commercial settings, such as hotels, hospitals, laundry services or other setting in which large numbers of dryers and are run through multiple cycles each day, several factors come into play. For example, it is often the case that textiles in a dryer should be dried to the point where they are "dry" but not "overdry." To that end, dryer monitor 20 may determine and notify laundry personnel when the textiles within dryer 2 are "dry." Dryer monitor 20 may also determine and notify laundry personnel when the textiles in dryer 2 are "overdry." By doing so, dryer monitor 20 may increase efficiency because employees need not run the dryer through an additional cycle to make sure the laundry is dry. In addition, by determining when textiles in a dryer are dry and alerting laundry personnel of that fact, dryer monitor 20 may result reduce excess energy consumption by helping to minimize the amount of time a dryer spends drying the textiles after a desired dryness level has been achieved.

For example, to determine whether items in the dryer are dry or overdry, dryer monitor 20 may use the system and/or methods described in U.S. patent application Ser. No. 11/526,515, filed Sep. 25, 2006, entitled "DETERMINATION OF DRYNESS OF TEXTILES IN A DRYER," which is incorporated herein by reference in its entirety. However, dryer monitor 20 may also use other ways to determine dryness and/or overdryness, and the disclosure is not limited in this respect.

As another example, certain laundry products may be used to condition textiles in the dryer during the dryer cycle. These include single-use laundry products, such as dryer sheets, and multi-use laundry products, such as solid blocks of fabric softener or other laundry conditioners that are gradually used up over the course of several dryer cycles. Examples of multi-use solid product blocks and associated carriers may be found in U.S. Pat. No. 6,779,740 to Lentsch, et al., issued Aug. 24, 2004; in U.S. Pat. No. 6,910,640 to Griese, et al., issued Jun. 28, 2005; and in U.S. Patent Application Publication Number 2003/0195130, to Lentsch, et al., published Oct. 16, 2003, each of which is incorporated herein by reference in its entirety. In the case of multi-use laundry products, dryer monitor 20 may also notify laundry personnel when these multi-use laundry products need to be replaced. Whether the laundry product needs to be replaced may be determined based on the number of cycles that the dryer has been through since the laundry product was installed in the dryer. Dryer monitor 20 may thus help to ensure that each load of laundry receives the proper amount of fabric conditioning by avoiding situations in which a dryer is run through one or more cycles with no fabric conditioning product.

To provide the dryer information, dryer monitor 20 includes at least one sensor 22. As mentioned above, dryer information obtained from sensor(s) 22 may be used as a gauge to monitor and analyze performance of the dryer 2 and to provide diagnostic information in the event that certain of the parameters are out of range. Sensor 22 may include, for example, humidity sensors, temperature sensors, moisture content sensors, dryer on/off sensors, etc. Sensors 22 may also include other sensors that may detect relevant data concerning operation and/or conditions within dryer 2. Sensors 22 may also include any other type of sensor that senses information concerning operation of a dryer, for example, sensors that sense information concerning the start or stop of a dryer cycle. When the specified level of dryness is sensed, dryer monitor 20 may alert the customer to prevent needless over-drying of the textiles. Preventing overdry textiles may help to conserve energy, reduce excess energy costs, and prevent premature textile degradation and/or damage. Information obtained from sensors 22 may also be used to count the number of cycles of dryer 2. The dryer cycle count may be used, for example, to alert laundry personnel when it is time to replace multi-cycle laundry products, to indicate when periodic or scheduled maintenance is to take place, to track the number of dryer cycles executed by the dryer over the lifetime of the dryer or during a defined period of time, etc.

Although dryer monitor 20 will be shown and described herein with respect to a clothes dryer, it shall be understood that dryer monitor 20 may be used with any type of drying equipment, and the disclosure is not limited in this respect. Such drying equipment may include, for example, dishwashers, warewashers, car washes, or other equipment where drying of an object or objects is required. In addition, dryer monitor 20 may be used to monitor and/or alarm to temperature, humidity or other environmental conditions in any application where such monitoring is required or desired. As with the clothes dryer example shown in FIG. 1, the sensors 22 may be located outside the drying compartment of the drying equipment, inside the drying compartment of the drying equipment. For example, one or more sensors 22 may be positioned to sense dryer information and/or cycle start information of exhaust air of the drying equipment.

When dryer monitor 20 is installed for use with an existing dryer in a commercial laundry setting, such as a hotel or commercial laundry establishment, it may be run using various default settings that may be programmed into dryer monitor 20 at the time of manufacture. Alternatively, dryer monitor 20 may be configured with customized settings by a service technician at the time of installation or at some later time. For example, a service technician may configure dryer monitor 20 by determining and setting customized settings for desired temperature and humidity profiles, the start and/or stop of a dryer cycle, dryer cycle counts, alerts, etc. By comparing the sensed dryer information from sensors 22 with the programmed default or customized settings, dryer monitor 20 may determine the status (e.g., whether the textiles within the dryer are not dry, dry or overdry) of the textiles within the dryer and/or may count dryer cycles. Dryer monitor 20 may then indicate via a status indicator, such as a visible or audible alarm, when the laundry is dry, when the laundry is "overdry" and/or when the specified number of dryer cycles has elapsed. Dryer monitor 20 may also determine and display a count of the number of dryer cycles that have occurred over the lifetime of the dryer or during a defined period of time.

Dryer monitor 20 may generate alerts concerning dryness of textiles in dryer or various fault conditions and transmit the alert to laundry personnel or a service technician. The alerts may be transmitted either wired or wirelessly. For example, the alerts may be transmitted via e-mail, text message, cell phone, or other means of electronic communication. In addition, dryer monitor 20 may transmit the so-called "dryer data," including one or more of temperature data, humidity data, cycle counts, motor status, fault conditions, and other data monitored or generated by dryer monitor to a local or remote computer for analysis and reporting.

Figure 2:
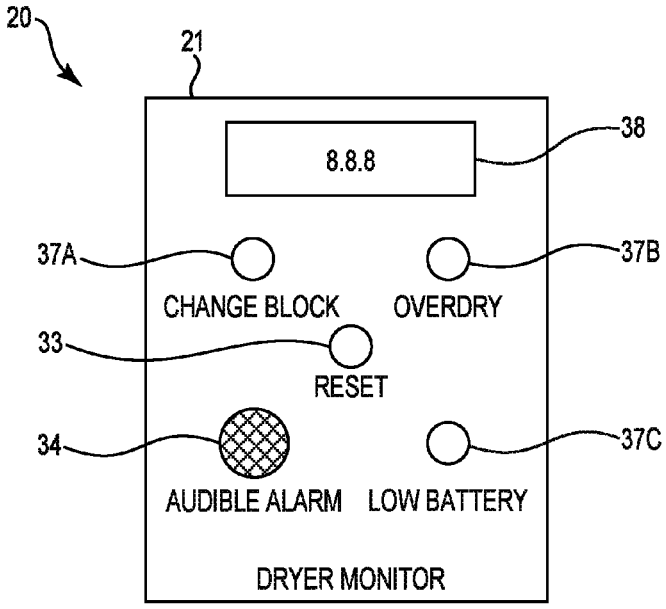
FIG. 2 is a front view illustrating an example control panel for dryer monitor 20.

FIG. 2 is a front view illustrating an example control panel for dryer monitor 20. Although FIG. 2 shows a specific physical layout of various visual and audible status indicators and user-actuatable elements such as buttons or switches, it shall be understood that the disclosure is not limited in this respect, and that any physical layout may be used without departing from the scope of the present disclosure.

In the example shown in FIG. 2, dryer monitor 20 is enclosed in a housing 21, and includes various visual and audible status indicators and user-actuatable elements for communication with a user. For example, dryer monitor 20 may include a display 38. Display 38 may include a push button to switch between displays of two or more different pieces of status information. Namely, display 38 may switch between a default display of the number of dryer cycles remaining before any multi-cycle laundry product is to be replaced and the total number of overdried loads that have occurred over a defined time period. Alternatively, display 38 may incorporate any desired numerical status information, text messages, etc. Dryer monitor 20 may also include several other status indicators 37, such as a change indicator 37A, an overdry indicator 37B, and/or a low battery indicator 37C. Status indicators 37 may be implemented using LEDs, alarms or any other suitable visible or audible indicator. An audible alarm 34 such as a beeper or buzzer may also be included.

For example, when the maximum number of dryer cycles is reached, dryer monitor may activate change indicator 37A and/or audible alarm 34. For example, change indicator 37A may light up or blink after a predetermined number of dryer cycles have been completed. At this point in time, the cycle count on display 38 might read "0" in the event that the display counts down from the maximum number of dryer cycles. A displayed cycle count of "0" in this instance may alert laundry personnel that it is time to replace the multi-cycle laundry product or perform preventive maintenance, for example.

In addition, when dryer monitor 20 determines that the textiles within the dryer have been "dry" for a certain length of time it may activate overdry indicator 37B. For example, overdry indicator 37B may light up or blink in a certain way when the linen has been determined to be "dry" for at least a defined number of minutes to alert the laundry staff to stop the dryer cycle and prevent an overdry condition. Alternatively or in addition, once dryer monitor 20 has determined that the dryer is operating in an "overdry" condition, overdry indicator 37B may light up or blink in a different way to alert the laundry staff of the overdry condition. Dryer monitor 20 may also track and/or display the amount of time the dryer operates in an overdry condition. Dryer monitor 20 may further calculate energy usage and energy cost information based on the amount of time dryer operates in an overdry condition. This information may be useful to managers of commercial laundry establishments to monitor and track excess energy usage and generally monitor operating conditions of the dryer.

Dryer monitor 20 may also activate a low battery indicator upon detection of a low battery condition. For example, low battery indicator 37C may light up or blink to alert laundry staff of the low battery condition.

Status indicators 37 and/or the audible alarm may run continuously, may blink, or may be activated on an intermittent basis, such as every few minutes, to save battery life. A reset button 33 restarts the cycle count after the maximum number of cycles has been reached and the corresponding action has been completed, such as replacement of the multi-cycle laundry product, preventive maintenance, etc., and/or may reset the overdry indicator.

Figure 3:
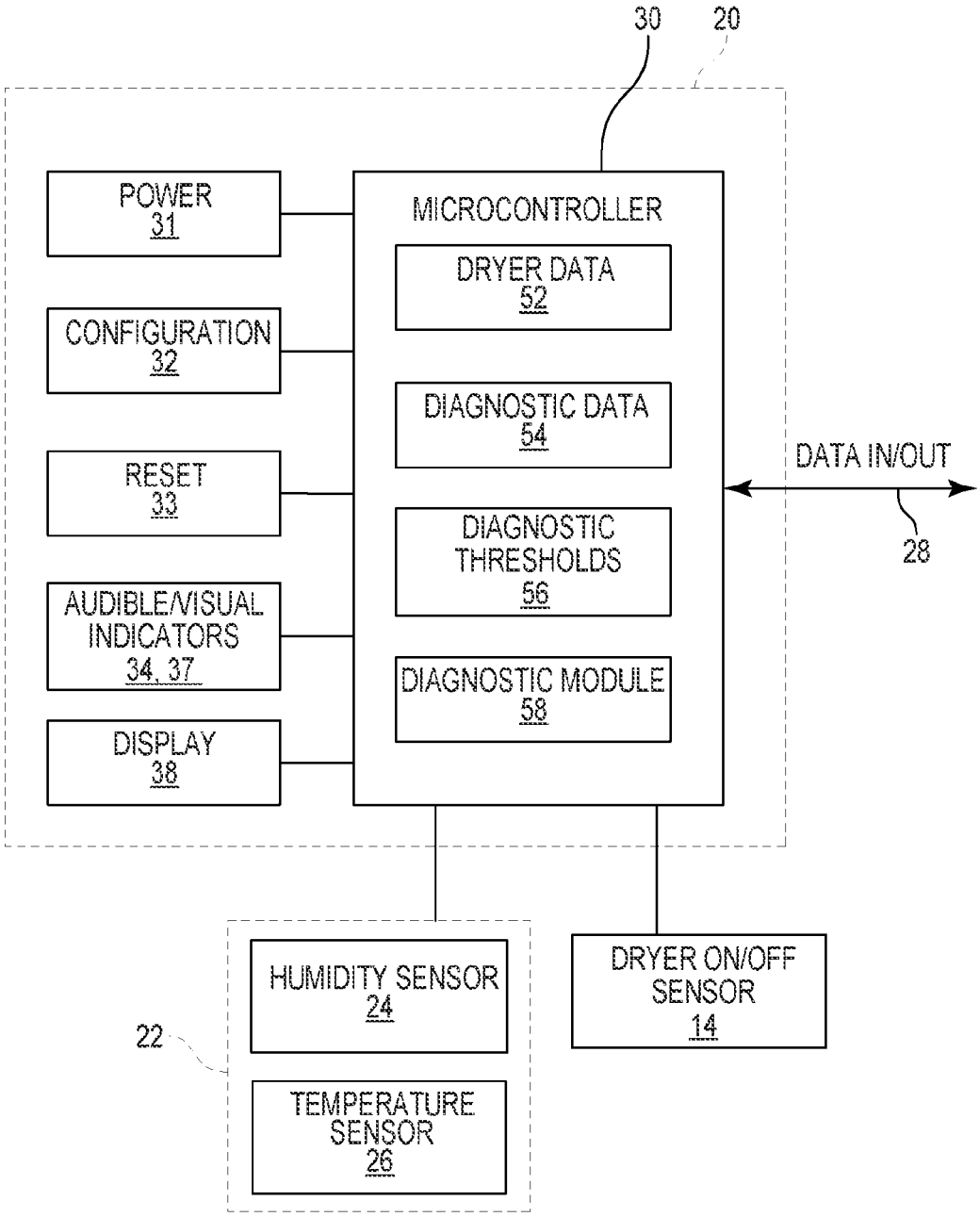
FIG. 3 is a block diagram illustrating an example of a dryer monitor.

FIG. 3 is a block diagram illustrating the electronic components of an example dryer monitor 20. In this example, dryer monitor 20 is a battery powered circuit containing an embedded microcontroller 30 that monitors the outputs of sensor(s) 22 and/or 14. Controller 30 also controls audible and visual indicators 34, 37. Microcontroller 30 also manages transmission of dryer data to local or remote computers, laptops, cell phones, PDAs, etc., and/or receipt of control instructions from any such local or remote computers, laptops, cell phones, PDAs, or other electronic device, etc via one or more input/out (I/O) connections indicated generally by line 28.

Specifically, microcontroller 30 may receive dryer information from sensors 22 and/14. Microcontroller 30 may store and/or analyze the dryer information obtained from sensor 22.

Sensor 22 may include a humidity sensor 24, a temperature sensor 26 and/or other type of sensor capable of sensing dryer information useful in monitoring or analyzing performance of a dryer.

The sensed dryer information received from any of sensors 24, 26, 14, and/or any other sensors that may obtain relevant information concerning operation of the dryer, may be stored by dryer monitor microcontroller as dryer data 52. "Dryer data" may include, for example, temperature information, humidity information, dryer on/off information, dryer rotation information, and any associated time/date stamps. "Dryer data" may also include, for example, the total number of dryer cycles executed by the dryer, the number of dryer cycles attributed to the current multi-cycle laundry product, and any other dryer data determined or calculated based on the information from any of the sensors.

The dryer monitor 20 stores one or more diagnostic thresholds 56. A diagnostic module 58 contains control software which, when executed by microcontroller 30, permits the dryer monitor to determine one or more status parameters concerning the operational conditions associated with the dryer. For example, diagnostic module 58 contains instructions via which the dryer monitor may identify possible mechanical failures of various dryer components, identify various ambient environmental conditions that may lead to inefficient drying, and/or identify possible operator errors. Diagnostic module 58 analyzes the sensed dryer information and/or other dryer data based on the diagnostic thresholds to determine the existence of any diagnostic conditions. Diagnostic module 58 may also include instructions concerning generation of alerts or notifications concerning the operational conditions of the dryer. The diagnostic data determined based on analysis of the sensed dryer information may also be stored as diagnostic data 54. "Diagnostic data" may include, for example, data concerning possible mechanical failures of various dryer components, ambient environmental conditions that may lead to inefficient drying, possible operator errors, and/or other diagnostic information that may be determined based on information received from the sensors. "Diagnostic data" may also include, for example, other computed information such as excess energy usage or excess energy cost corresponding to excess energy used during the amount of time the dryer has operated in an overdry condition.

Dryer monitor 20 is a diagnostic device that can be used with any drying equipment. For example, dryer monitor 20 may be an auxiliary device that may be added to dryers without dryness sensing capability. As such, dryer monitor 20 may include its own power supply 31. Power supply 31 may include, for example, 9V or AA, or other type of battery. As another example, dryer monitor 20 may be integrated into a dryer at the time of manufacture. In that example, dryer monitor 20 may be wired to receive power from dryer's power supply.

When dryer monitor 20 is used with an existing dryer in a commercial laundry setting, such as a hotel or commercial laundry establishment, a service technician may configure dryer monitor 20 and/or set various diagnostic and dryer thresholds by determining and setting diagnostic thresholds 56 which determine when dryer monitor 20 should activate an alert. To that end, dryer monitor 20 may include configuration elements 32 via which a service technician may customize these and various other system parameters for each specific dryer installation. Configuration elements 32 may be implemented using dip switches, jumpers or the like. Alternatively, the system may be configured via software commands entered via the control panel 21, or may be auto-configured via NVRAM or other stored memory device. As another example, dryer monitor may be configured remotely via a wired or wireless connection to a local or remote computer, laptop, cell phone, PDA, or other electronic device.

In some examples, controller 30 may detect the start and/or a finish of a laundry cycle based on temperature information obtained from temperature sensor 26. The cycle count may be stored in memory. Each time controller 30 detects the start of a dryer cycle, controller 30 updates the stored cycle count. The cycle count may then be compared to a maximum cycle count, if implemented, as set up during installation of the dryer monitor 20 to determine how many cycles remain before the maximum cycle count is reached. Controller 30 may then display the remaining cycles on display 38. The displayed remaining cycle count may be used as a "countdown" from the maximum cycle count. For example, a displayed cycle count of zero may indicate that a multi-use laundry product should be replaced or that periodic maintenance should be performed. The countdown may also be indicative of any other status condition of a dryer as may be determined by those of skill in the art. Alternatively, the cycle count may be displayed as running total of the number of dryer cycles completed by the dryer. For example, dryer monitor 20 may count dryer cycles using the system and/or methods described in U.S. patent application Ser. No. 11/526,515, filed Sep. 25, 2006, entitled "DETERMINATION OF DRYNESS OF TEXTILES IN A DRYER," which is incorporated herein by reference in its entirety.

Reset 33, which may be a button, knob or other input element, may be used to reset the cycle count once the maximum number of cycles has been reached, any multi-use laundry products have been replaced, or other reason for monitoring the number of dryer cycles has been dealt with. Reset 33 may also reset overdry indicator 37.

In the examples shown and described above, dryer monitor 20 is associated with a single dryer 2. However, in other examples, dryer monitor 20 may be associated with multiple dryers 2. For example, dryer monitor 20 may receive information concerning the dryness of textiles from a plurality of sensors 22, each sensor associated with one or more of a plurality of dryers 2. In this way, dryer monitor 20 may monitor dryer information for one or more dryers at a laundry location or a group of laundry locations. Such as feature may be useful, for example, in locations with more than one dryer, such as hotels or commercial laundry establishments. In such example environments, dryer monitor 20 may be mounted on one of the plurality of dryers or may be located in a central control area rather than mounted on a dryer front.

In the event of a humidity sensor, sensor(s) 22 may sense relative humidity, absolute humidity or some other humidity measure. Similarly, humidity and/or temperature levels may be measured in the lint compartment, inside drum 4, behind lint screen 10, or other location with respect to dryer 2. Dryer monitor 20 may further incorporate other features in addition to those described above. For example, dryer monitor 20 may include a timer that tracks the length in time of each dryer cycle, and/or tracks the total combined time of all dryer cycles in the lifetime of the dryer or since a defined point in time.

Dryer monitor 20 may also use the overdry timer which tracks the amount of time the dryer operates in the overdry condition to further calculate and store information concerning excess energy usage and the cost associated with that excess energy usage. For example, knowing the amount of time the dryer operates in the overdry condition (via overdry timer), and knowing certain specifications of the dryer such as average energy usage per unit time, dryer monitor 20 may calculate the amount of excess energy unnecessarily expended in the overdry condition (that is, continuing to operate the dryer after the laundry is already dry). In addition, knowing the rate of utility cost per unit time, dryer monitor 20 could also determine the cost of that excess energy usage. Tracking and reporting of excess energy usage and cost to management personnel may be very valuable for the overall management and operation of commercial laundry establishments.

Dryer monitor 20 may also monitor and/or diagnose various dryer parameters indicative of the general operation and condition of a dryer. By monitoring one or more types of dryer information, such as temperature and/or humidity over time, dryer on/off information, and/or the dryer rotational status (whether the drum is rotating or not), one or more diagnostic conditions of the dryer (including dryer mechanical fault conditions, cycle counts, possible operator errors, textile dryness or overdryness) may be obtained and stored in the memory of the dryer monitor 20. Analysis of this data, either locally by the dryer monitor or via a remote computer, may be used to generate reports concerning dryer operations and/or identify changes that occur with the dryer over time.

Dryer data, including temperature data, humidity data, dryer on/off data, dryer rotational status data, and/or other relevant dryer data, may be analyzed in one or more different ways, either alone or in combination, to determine one or more dryer diagnostic conditions of the dryer. For example, one or more dryer parameters may be determined by analyzing the dryer data as temperature alone; humidity alone; rotation alone; a combination of temperature and humidity; a combination of temperature and rotation; a combination of humidity and rotation; a combination of temperature, humidity, and rotation; and/or the dryer cycle time.

Figure 4:
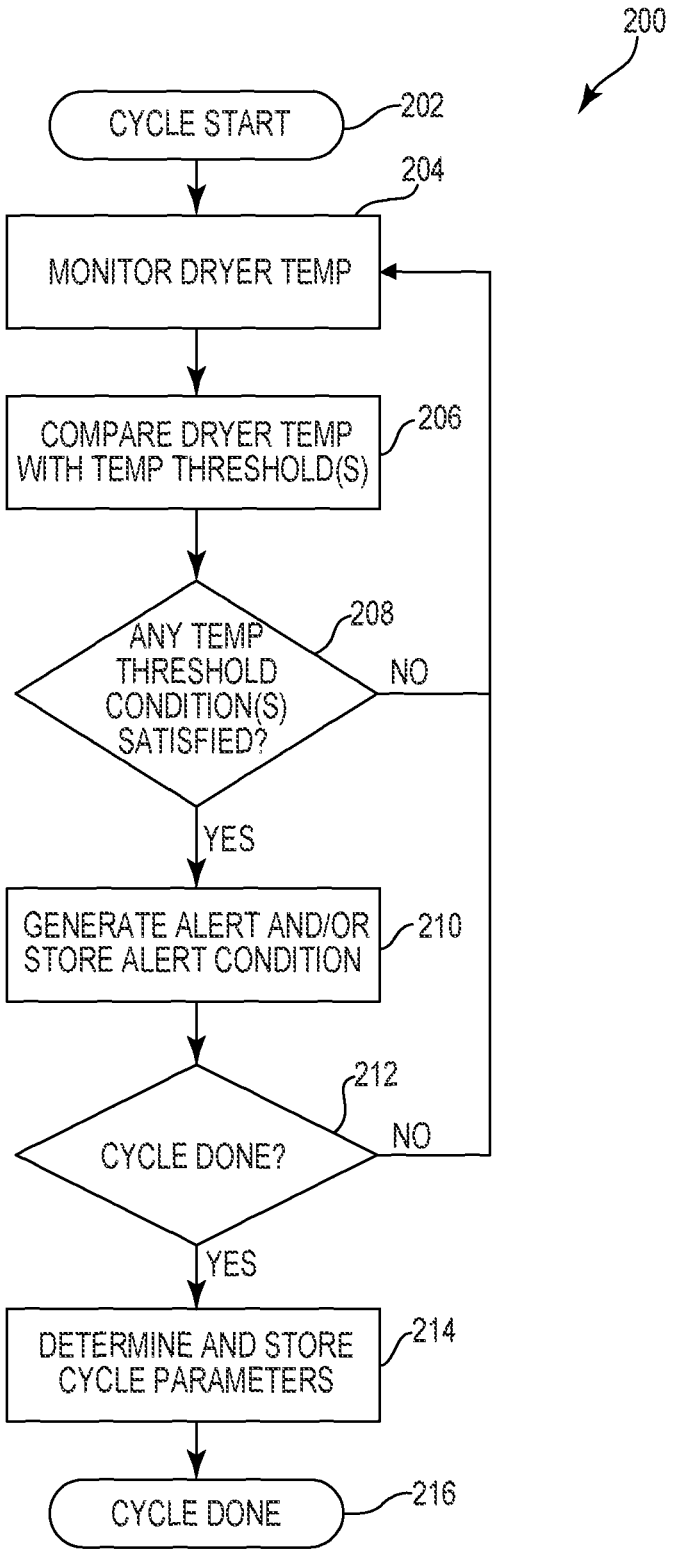
FIG. 4 is a flow chart illustrating an example process by which dryer monitor may determine one or more dryer parameters based on temperature information.

FIG. 4 is a flow chart illustrating an example process (200) by which dryer monitor 20 may determine one or more dryer parameters based on temperature information. Process (200) may be included in, for example, dryness module 52, and/or diagnostic module 54 of FIG. 3. The temperature information may be obtained from a temperature sensor, such as temperature sensor 26 as shown in FIG. 3. When the dryer cycle starts (202), dryer monitor 20 monitors the dryer temperature (204). For example, microcontroller 30 of FIG. 3 may receive temperature information from temperature sensor 26. The temperature information is compared with one or more temperature thresholds (206). If none of the temperature thresholds are satisfied (206), the dryer monitor continues to monitor the dryer temperature (204). If any of the temperature thresholds are satisfied (208), the dryer monitor generates and stores a corresponding alert condition. If the cycle is not yet done (212), the dryer monitor continues to monitor the dryer temperature (204). When the dryer cycle is done (212), the dryer monitor may determine and store various parameters concerning the just completed dryer cycle (214). For example, the dryer monitor may determine the cycle peak temperature and cycle minimum temperature. The dryer monitor may determine the total cycle time, the total overdry time, etc. The dryer monitor may also determine some or all of the following:

| Example Reported Parameters |
|---|
| Number of cycles since data last cleared |
| Number of over dry cycles since data last cleared |
| Total time to dry/cycle |
| Total time in dry/cycle |
| Total time in over dry/cycle |
| Total time in cooling/cycle |
| Highest temperature during the cycle |
| Lowest temperature during the cycle |

-continued

| Example Reported Parameters |
|---|
| Lowest temperature during the cycle |
| Highest humidity during the cycle |
| Lowest humidity during the cycle |
| Temperature at cycle start |
| Relative Humidity at cycle start |
| Temperature at cycle end |
| Relative and/or Absolute Humidity at cycle end |
| Total time in Anti-Wrinkle mode (some dryers go into an automatic cycle when heat is done, in which they turn on/off alternately for 2½ minutes so the linen doesn't wrinkle). |
| Dryer Idle time (might help to determine laundry room efficiencies, throughput compared to number of washers, etc.) |

At this point the cycle is complete (216).

As mentioned above, the dryer monitor may analyze the temperature information based on one or more temperature thresholds. Example temperature thresholds are shown in the following table:

| Temperature Threshold | Definition |
|---|---|
| Thigh.normal | A standard range of maximum temperatures after a drying cycle has started, [Thigh.low, Thigh.high] |
| Tlow.normal | A standard temperature range prior to starting a drying cycle, [Tstart.low, Tstart.high] |

To perform the analysis and determine whether any of the one or more temperature threshold conditions are satisfied (206, 208), the following table lists example threshold conditions and possible status conclusions that may be drawn from satisfaction of the threshold condition.

| Temperature Threshold Condition | Status |
|---|---|
| Temperature greater than Thigh.normal | Possible temperature limiting mechanism failure—may damage linen. |
| Temperature less than Thigh.normal | Burner inefficient, valve not opening, door not properly closed, cold sensor temperature reading |
| Temperature less than Thigh.normal | Air intake exposed to very cold air—may not be able to dry linen |
| Temperature higher than Tlow.normal | Possibly due to "crosstalk" conditions due to venting conditions from other dryers in the system* |

*"Crosstalk" can occur in dryer installations in which multiple dryers are placed or stacked in close proximity to each other. The heat, humidity, and/or venting conditions of one dryer during the course of an active dryer cycle may affect the temperature and/or humidity sensed by dryer monitors associated with other dryers in close proximity.

Figure 5:
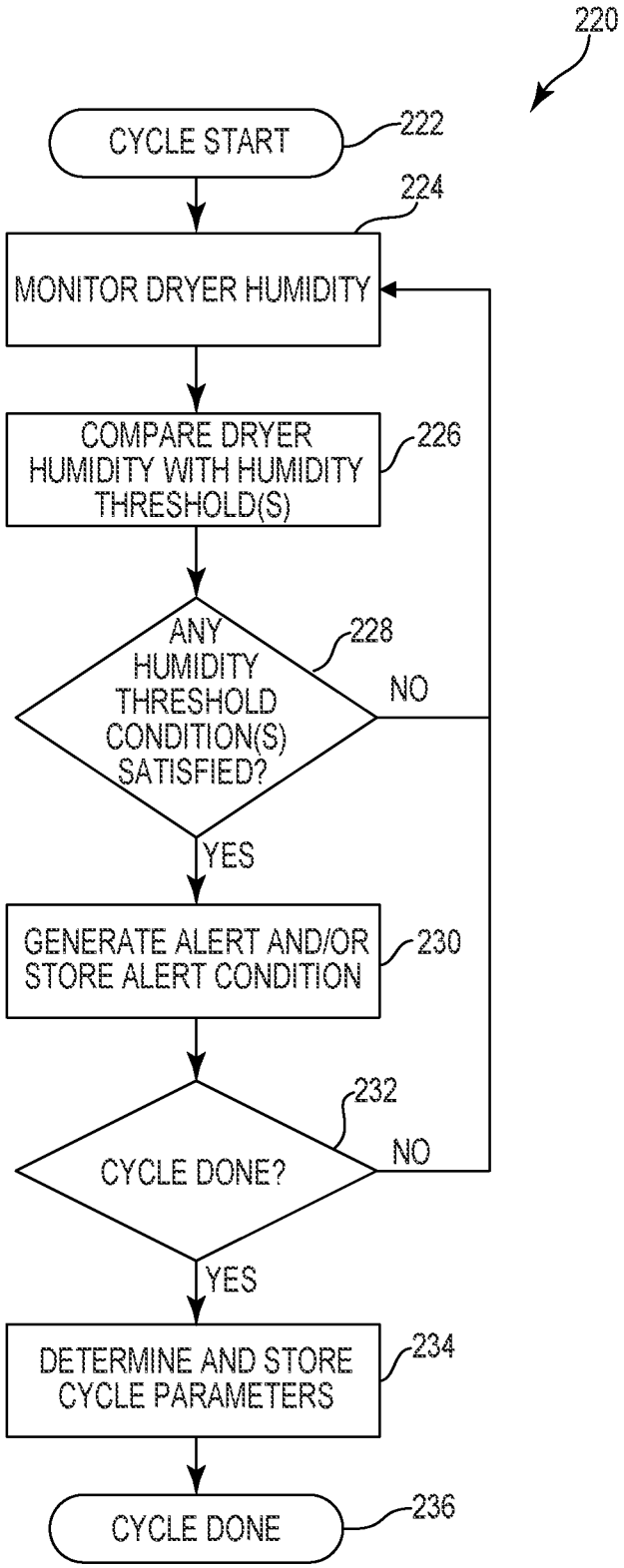
FIG. 5 is a flow chart illustrating an example process by which dryer monitor may determine one or more dryer parameters based on humidity information.

FIG. 5 is a flow chart illustrating an example process (220) by which dryer monitor 20 may determine one or more dryer parameters based on humidity information. Process (220) may be included in whole or in part in one or both of dryness module 52 or diagnostic module 54.

When the dryer cycle starts (222), dryer monitor 20 monitors the dryer humidity (224). For example, microcontroller 30 of FIG. 3 may receive humidity information from humidity sensor 24. The humidity information is compared with one or more humidity thresholds (226). If none of the humidity thresholds are satisfied (228), the dryer monitor continues to monitor the dryer humidity (224). If any of the humidity thresholds are satisfied (228), the dryer monitor generates and stores a corresponding alert condition (230). If the cycle is not yet done (232), the dryer monitor continues to monitor the dryer humidity (224). When the dryer cycle is done (232), the dryer monitor may determine and store various parameters concerning the just completed dryer cycle (234). For example, the dryer monitor may determine the cycle peak humidity and cycle minimum humidity. The dryer monitor may determine the total cycle time, the total overdry time, etc., or other parameters listed herein. At this point the cycle is complete (216).

As mentioned above, the dryer monitor may analyze the humidity information based on one or more humidity thresholds. Example humidity thresholds are shown in the following table:

| Humidity Threshold | Definition |
|---|---|
| Hhigh.normal | A standard range of lowest humidities after a drying cycle has started, [Hhigh.low, Hhigh.high] |
| Hlow.normal | A standard humidity range prior to starting a drying cycle, [Hlow.low, Hlow.high] |

To perform the analysis and determine whether any of the one or more humidity threshold conditions are satisfied (226, 228), the following table lists example threshold conditions and possible status conclusions that may be drawn from satisfaction of the threshold condition.

| Humidity Threshold Condition | Status |
|---|---|
| Humidity greater than Hhigh.normal | i) Insufficient water extraction—will increase drying time<br>ii) High ambient humidity—probably a normal condition |
| Humidity less than Hhigh.normal | This may be due to ambient conditions dryer than previous period of time (e.g., that time that makes up Hhigh.normal); double drying/multiple cycles; washer is over extracting (water removal spin cycle) which may cause linen damage |
| Humidity greater than Hlow.normal | Poor drying efficiencies due to: burner issues, cold sensor conditions |
| Humidity less than Hlow.normal | Overdrying—wastes energy and may damage linen |

Figure 6:
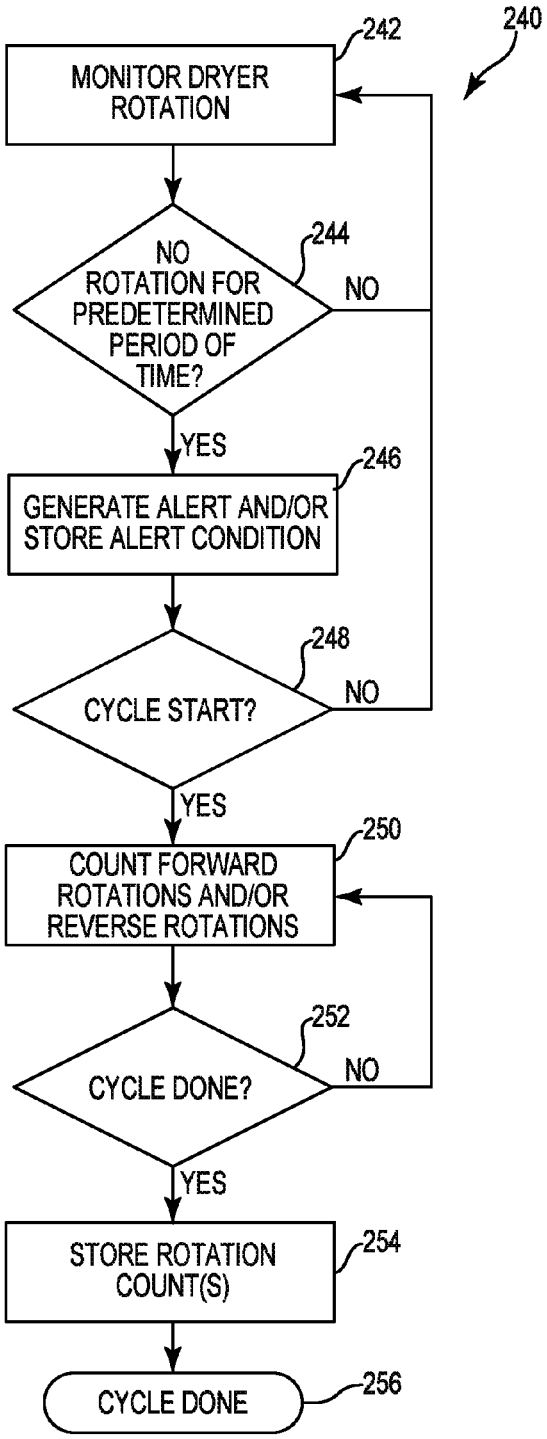
FIG. 6 is a flow chart illustrating an example process by which dryer monitor may determine one or more dryer parameters based on dryer rotation information.

FIG. 6 is a flow chart illustrating an example process (240) by which dryer monitor 20 may determine one or more dryer parameters based on dryer rotation information. Process (240) may be included in whole or in part in one or both of dryness module 52 or diagnostic module 54.

In this example, dryer monitor 20 monitors whether the dryer drum is rotating. The dryer rotation information is based on sensed information received from the motor sensor, such as dryer on/off sensor 14 in FIG. 1. If the motor is running, this is an indication that the drum is rotating and the dryer is currently executing a dryer cycle. By monitoring whether or not the motor is running, the dryer monitor may determine whether no rotation has occurred for a predetermined period of time (244). If the predetermined period of time with no dryer rotation has not yet elapsed (244), the dryer monitor continues to monitor rotation of the dryer (242). If no rotation has been detected for the predetermined period of time, the dryer monitor generates and stores a corresponding alert condition (246). The dryer monitor continues to monitor rotation of the dryer until a cycle has started (or, dryer rotation is detected) (248). Once the cycle has started, the dryer monitor may count the number of forward and/or backward rotations of the drum (250). If the cycle is not yet done (248), the dryer monitor continues to count dryer rotations (250). When the dryer cycle is done (252), the dryer monitor may determine and store various parameters concerning the just completed dryer cycle (254). For example, the dryer monitor may determine the total number of forward and/or reverse rotation counts. The dryer monitor may also determine the total cycle time, etc., or any other parameters listed herein. At this point the cycle is complete (256).

To perform the analysis and determine whether any of the one or more rotation threshold conditions are satisfied (244, 250), the following table lists example threshold conditions and possible status conclusions that may be drawn from satisfaction of the threshold condition.

| Rotation Threshold Condition | Status |
|---|---|
| No rotation has been detected over a period of time | i) Notification of dryer not being used<br>ii) Possible motor detection device failure (i.e. temperature or humidity varies with no motor on sensing) |
| Regular stops and starts | i) Reversing drum—normal for some cycles; perhaps they are not operating dryer most efficiently when drying sheet<br>ii) There may be value in knowing the number of reversing cycle versus non-reversing cycle counts<br>iii) Might be value in setting control parameters be modified depending on reversing versus non-reversing mode—that is, change drying characteristics when drying sheets |

Figure 7:
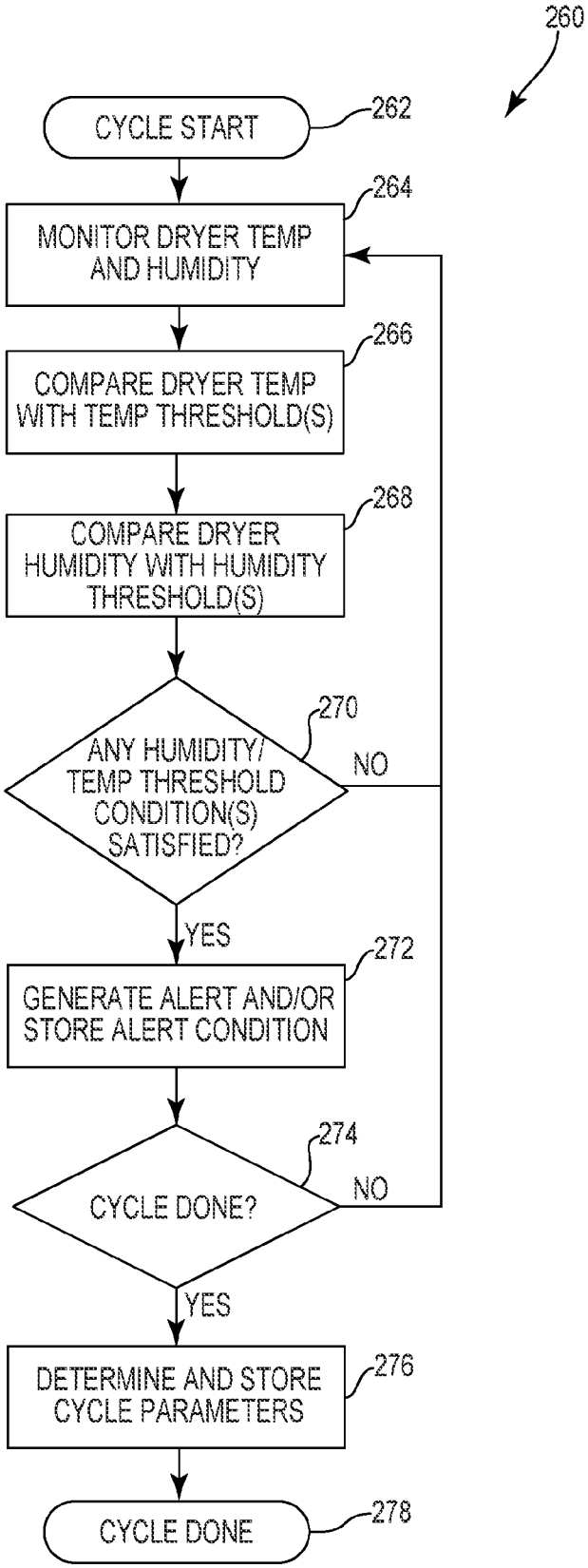
FIG. 7 is a flow chart illustrating an example process by which dryer monitor may determine one or more dryer parameters based on temperature and humidity information.

FIG. 7 is a flow chart illustrating an example process (260) by which dryer monitor 20 may determine one or more dryer parameters based on temperature and humidity information. Process (260) may be included in whole or in part in one or both of dryness module 52 or diagnostic module 54.

When the dryer cycle starts (262), dryer monitor 20 monitors the dryer temperature and humidity (264). For example, microcontroller 30 of FIG. 3 may receive temperature information from temperature sensor 26 and humidity information from humidity sensor 24. The temperature and humidity information is compared with one or more temperature and/or humidity thresholds, respectively (266, 268). If none of the temperature/humidity threshold condition(s) are satisfied (270), the dryer monitor continues to monitor the dryer temperature and humidity (264). If any of the temperature/humidity threshold conditions are satisfied (270), the dryer monitor generates and stores a corresponding alert condition (272). If the cycle is not yet done (274), the dryer monitor continues to monitor the dryer temperature and humidity (264). When the dryer cycle is done (274), the dryer monitor may determine and store various parameters concerning the just completed dryer cycle (276). For example, the dryer monitor may determine the cycle peak humidity and cycle minimum humidity. For example, the dryer monitor may determine the cycle peak temperature and cycle minimum temperature. The dryer monitor may determine the total cycle time, the total overdry time, etc., and/or any of the parameters listed herein. At this point the cycle is complete (278).

To perform the analysis and determine whether any of the one or more temperature/humidity threshold conditions are satisfied (270), the following table lists example threshold conditions and possible status conclusions that may be drawn from satisfaction of the threshold condition.

| Temp + Humidity Threshold Condition | Status |
|---|---|
| Increasing temperature and decreasing humidity | i) Start of a new dryer cycle<br>ii)Ambient air change |
| Decreasing temperature and increasing humidity | i) Dryer burner no longer active<br>ii) Dryer is in cooling mode<br>iii) Ambient air change |

Figure 8:
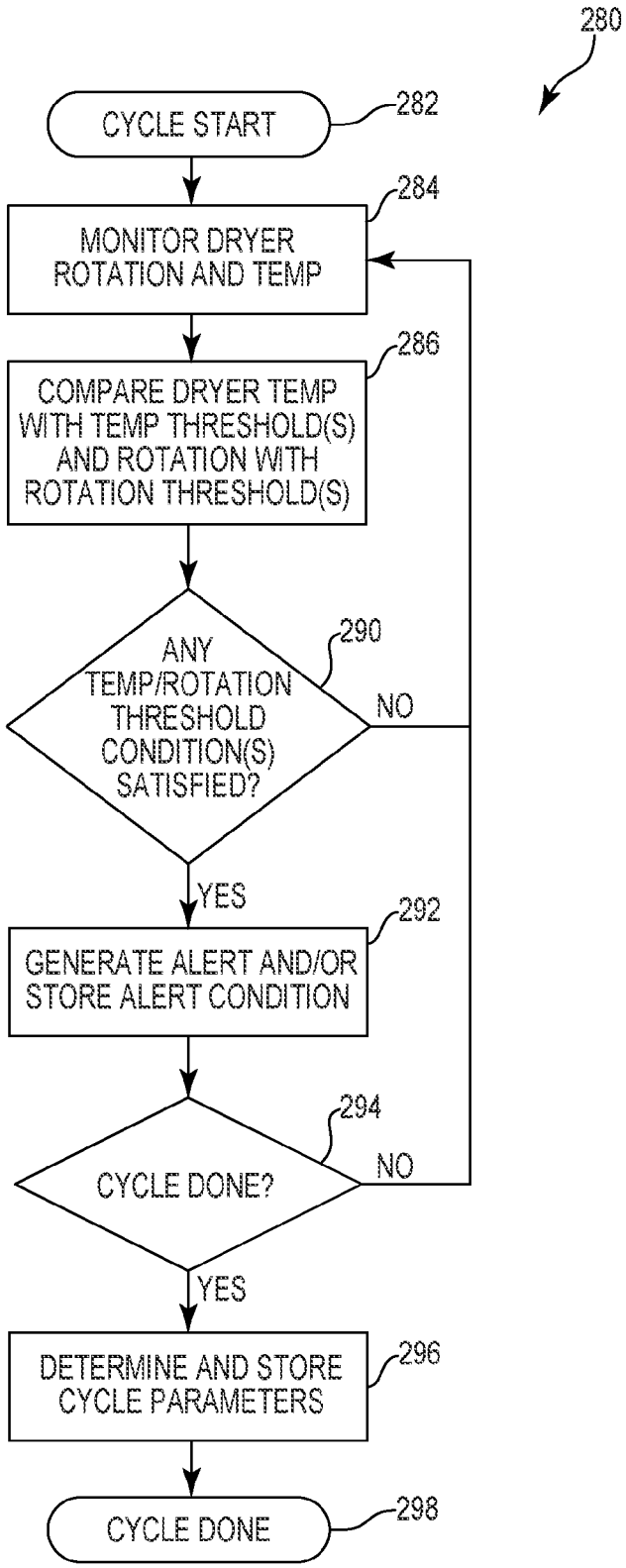
FIG. 8 is a flow chart illustrating an example process by which dryer monitor may determine one or more dryer parameters based on temperature and rotation information.

FIG. 8 is a flow chart illustrating an example process (280) by which dryer monitor 20 may determine one or more dryer parameters based on temperature and rotation information. Process (280) may be included in whole or in part in one or both of dryness module 52 or diagnostic module 54.

When the dryer cycle starts (282), dryer monitor 20 monitors the dryer temperature and rotation information (284). For example, microcontroller 30 of FIG. 3 may receive temperature information from temperature sensor 26 and dryer rotation information from dryer on/off sensor 14. The temperature and rotation information is compared with one or more temperature and/or rotation thresholds, respectively (286). If none of the temperature/rotation threshold condition(s) are satisfied (290), the dryer monitor continues to monitor the dryer temperature and rotation (284). If any of the temperature/rotation threshold conditions are satisfied (290), the dryer monitor generates and stores a corresponding alert condition (292). If the cycle is not yet done (294), the dryer monitor continues to monitor the dryer temperature and rotation (284). When the dryer cycle is done (294), the dryer monitor may determine and store various parameters concerning the just completed dryer cycle (296). For example, the dryer monitor may determine the cycle peak temperature and cycle minimum temperature. For example, the dryer monitor may determine the total number of forward and/or backward rotations of the dryer. The dryer monitor may determine the total cycle time, the total overdry time, etc., or any of the parameters listed herein. At this point the cycle is complete (298).

To perform the analysis and determine whether any of the one or more temperature/rotation threshold conditions are satisfied (290), the following table lists example threshold conditions and possible status conclusions that may be drawn from satisfaction of the threshold condition.

| Temp + Rotation Threshold Condition | Status |
|---|---|
| Rotation with increasing temperature | Dryer coming up to temperature |
| Rotation with decreasing temperature | i) Dryer burner problem<br>ii) Cooling mode<br>iii) Ambient air change<br>iv) Door not properly closed |
| Rotation with oscillating temperature | Burner cycling during drying—normal |
| Rotation stopping with high temperature | i) Cycle ended early (short cycle)<br>ii) Crosstalk between dryer vents<br>iii) No cooling cycle used |

Figure 9:
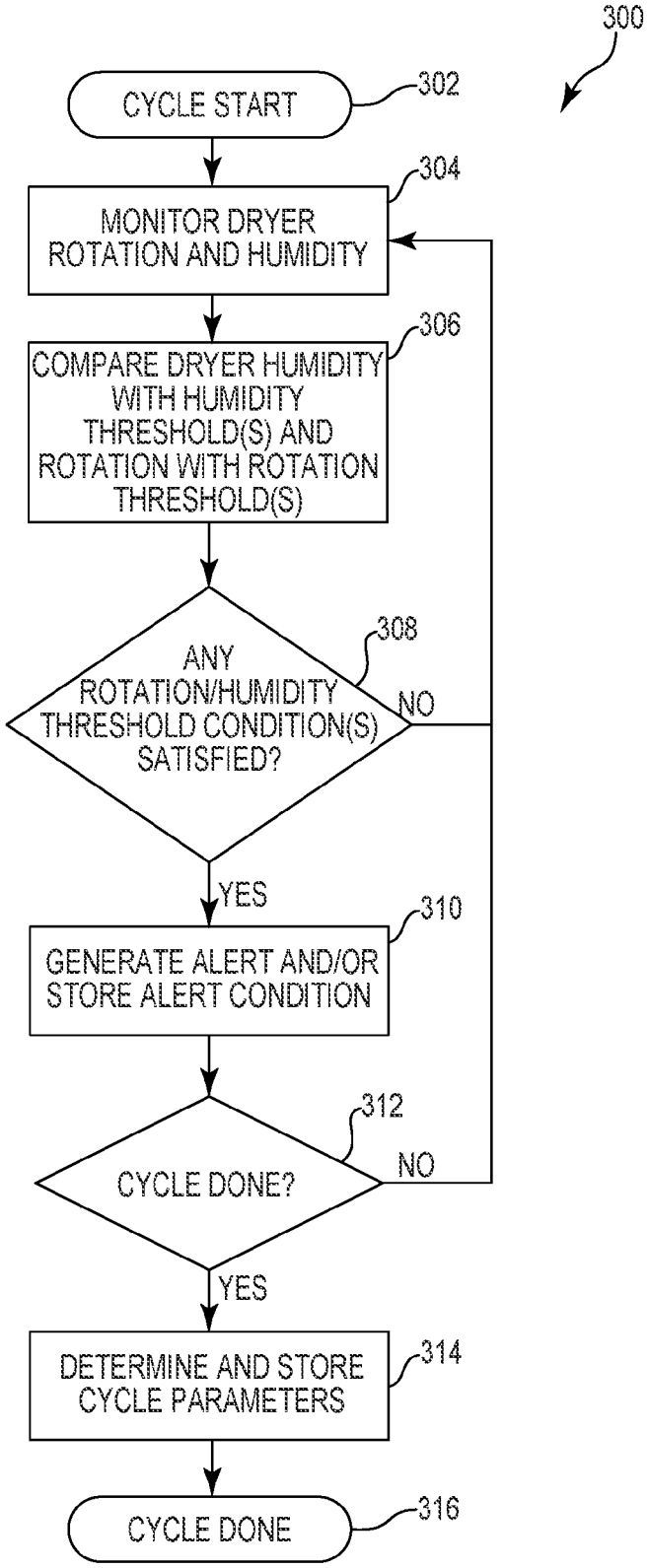
FIG. 9 is a flow chart illustrating an example process by which dryer monitor may determine one or more dryer parameters based on humidity and rotation information.

FIG. 9 is a flow chart illustrating an example process (300) by which dryer monitor 20 may determine one or more dryer parameters based on humidity and rotation information. Process (280) may be included in whole or in part in one or both of dryness module 52 or diagnostic module 54.

When the dryer cycle starts (302), dryer monitor 20 monitors the dryer humidity and rotation information (304). For example, microcontroller 30 of FIG. 3 may receive humidity information from humidity sensor 24 and dryer rotation information from dryer on/off sensor 14. The humidity and rotation information is compared with one or more humidity and/or rotation thresholds, respectively (306). If none of the humidity/rotation threshold condition(s) are satisfied (308), the dryer monitor continues to monitor the dryer humidity and rotation (304). If any of the humidity/rotation thresholds are satisfied (308), the dryer monitor generates and stores a corresponding alert condition (310). If the cycle is not yet done (312), the dryer monitor continues to monitor the dryer humidity and rotation (284). When the dryer cycle is done (312), the dryer monitor may determine and store various parameters concerning the just completed dryer cycle (314). For example, the dryer monitor may determine the cycle peak humidity and cycle minimum humidity. For example, the dryer monitor may determine the total number of forward and/or backward rotations of the dryer. The dryer monitor may determine the total cycle time, the total overdry time, etc., or any of the parameters listed herein. At this point the cycle is complete (298).

To perform the analysis and determine whether any of the one or more humidity/rotation threshold conditions are satisfied (308), the following table lists example threshold conditions and possible status conclusions that may be drawn from satisfaction of the threshold condition.

| Humidity + Rotation Threshold Condition | Status |
|---|---|
| Rotation with decreasing humidity | Normal drying |
| Rotation with stable low humidity | Linen is approaching dry or overdry |
| Rotation with increasing humidity | i) Cooling mode<br>ii) Ambient air change<br>iii) Start of new dryer cycle<br>iv) Additional wet linen has been added to the dryer mid-cycle |
| Rotation with abnormally high humidity | Possible washer extraction inefficient |

Figure 10:
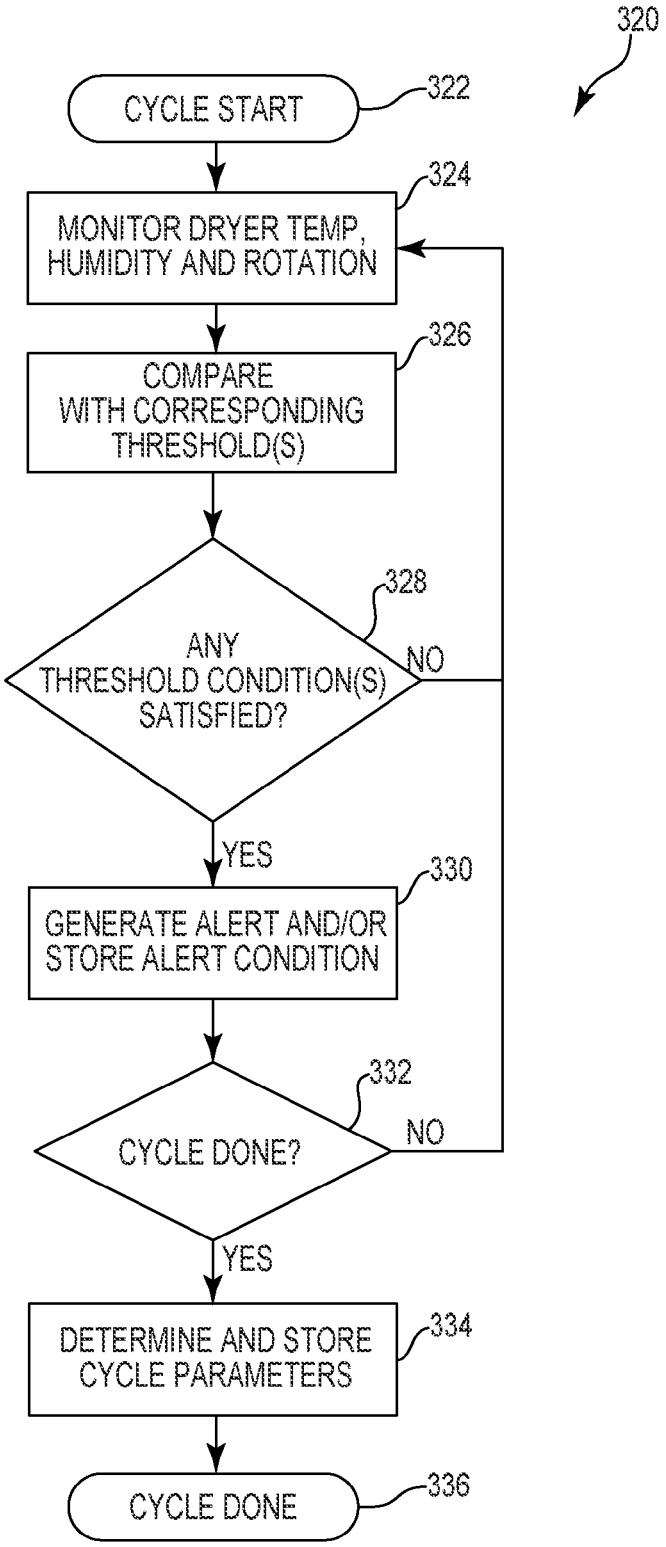
FIG. 10 is a flow chart illustrating an example process by which dryer monitor may determine one or more dryer parameters based on temperature, humidity, and rotation information.

FIG. 10 is a flow chart illustrating an example process (320) by which dryer monitor 20 may determine one or more dryer parameters based on temperature, humidity, and rotation information. Process (320) may be included in whole or in part in one or both of dryness module 52 or diagnostic module 54.

When the dryer cycle starts (322), dryer monitor 20 monitors the dryer temperature, humidity, and rotation information (324). For example, microcontroller 30 of FIG. 3 may receive temperature information from temperature sensor 26, humidity information from humidity sensor 24, and dryer rotation information from dryer on/off sensor 14. The temperature, humidity, and rotation information is compared with one or more temperature, humidity, and/or rotation thresholds, respectively (326). If none of the temperature/humidity/rotation threshold condition(s) are satisfied (328), the dryer monitor continues to monitor the dryer temperature, humidity, and rotation (324). If any of the temperature/humidity/rotation thresholds are satisfied (328), the dryer monitor generates and stores a corresponding alert condition (330). If the cycle is not yet done (332), the dryer monitor continues to monitor the dryer temperature, humidity, and rotation (324). When the dryer cycle is done (332), the dryer monitor may determine and store various parameters concerning the just completed dryer cycle (334). For example, the dryer monitor may determine the cycle peak temperature and cycle minimum temperature. For example, the dryer monitor may determine the cycle peak humidity and cycle minimum humidity. For example, the dryer monitor may determine the total number of forward and/or backward rotations of the dryer. The dryer monitor may determine the total cycle time, the total overdry time, etc., or any of the parameters listed herein. At this point the cycle is complete (336).

To perform the analysis and determine whether any of the one or more temperature/humidity/rotation threshold conditions are satisfied (328), the following table lists example threshold conditions and possible status conclusions that may be drawn from satisfaction of the threshold condition.

| Temp + Humidity + Rotation Threshold Condition | Status |
|---|---|
| Rotation + high non-decreasing humidity + low non-increasing temperature | i) Burner failure<br>ii) Incoming hot air blockage |
| Rotation + decreasing humidity + high temperature | Normal drying |
| Rotation + low non-decreasing humidity + high temperature | Linen is overdry |
| Rotation + slow rate of humidity change + high temperature (relative to temperature at cycle start) | i) Lint screen is blocking/ impeding air flow<br>ii) Small load |
| Rotation + decreasing temperature + increasing humidity | Cooling mode |
| Rotation stops while almost dry, dry, or overdry; temperature decreases or stays the same; humidity increases or stays the same | Cycle stopped |
| Rotation stops; temperature stays high, humidity increases quickly | Short cycle (open door, remove dry linen, load wet linen) |
| Rotation not detected but temperature and humidity operate normally | i) Motor on sensor or electrical connection failure<br>ii) Crosstalk between dryer vents |

Figure 11:
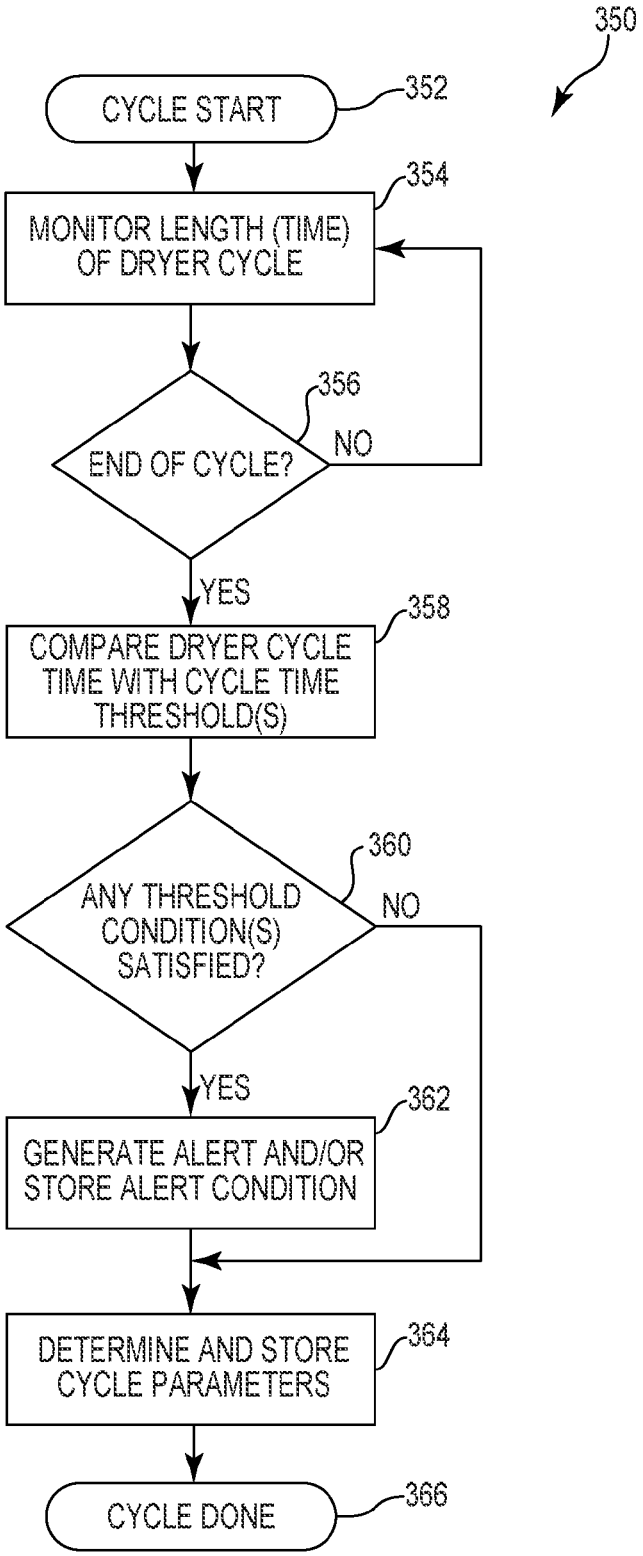
FIG. 11 is a flow chart illustrating an example process by which dryer monitor may determine one or more dryer parameters based on dryer cycle time information.

FIG. 11 is a flow chart illustrating an example process (350) by which dryer monitor 20 may determine one or more dryer parameters based on dryer cycle time information. Process (350) may be included in whole or in part in one or both of dryness module 52 or diagnostic module 54.

When the dryer cycle starts (352), dryer monitor 20 monitors the length of the dryer cycle (354) until the dryer cycle done (356). When the dryer cycle is done (356), the dryer monitor may compare the just completed dryer cycle time with one or more cycle time thresholds (358). If the dryer cycle time satisfies any of the dryer cycle time thresholds (360) the dryer monitor may generate and store a corresponding alert condition (362). The dryer monitor may further determine and store various parameters concerning the just completed dryer cycle (364). For example, the dryer monitor may store the dryer cycle time for that dryer cycle, or any of the parameters listed herein. At this point the cycle is complete (366).

To perform the analysis and determine whether any of the one or more dryer cycle time threshold conditions are satisfied (360), the following table lists example threshold conditions and possible status conclusions that may be drawn from satisfaction of the threshold condition.

| Dryer Cycle Time Threshold Condition | Status |
|---|---|
| Time to dry longer than normal | i) Lint screen blocking/impeding air flow<br>ii) Possible washer extraction inefficient |

Figure 12:
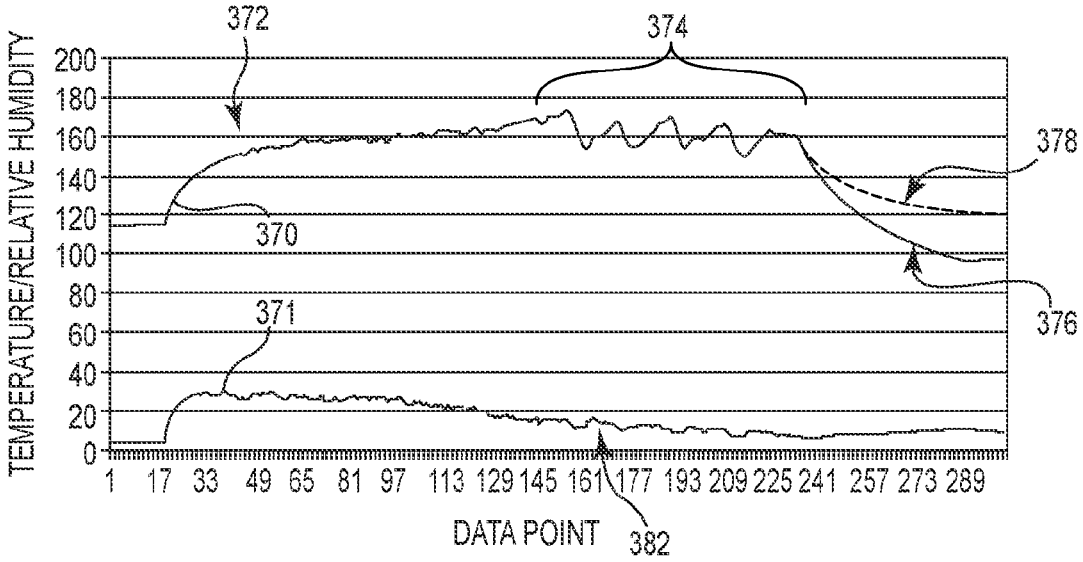
FIG. 12 is a graph of an example dryer cycle, showing graphs of the dryer temperature and relative humidity over the course of a dryer cycle.
Figure 13A:
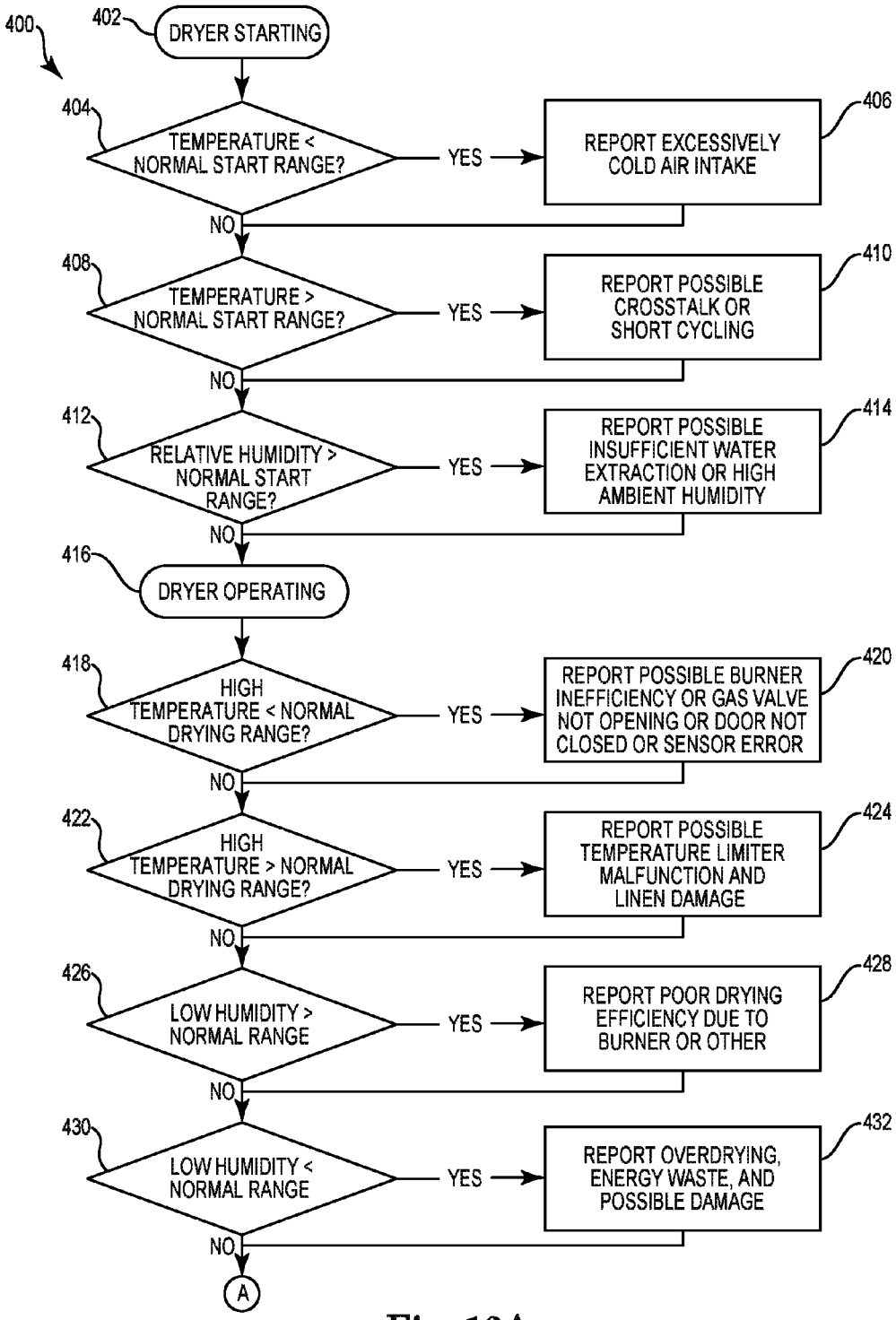
FIGS. 13A-13D are a flowchart illustrating an example process by which a dryer monitor may determine various parameter concerning operation of a dryer.
Figure 13B:
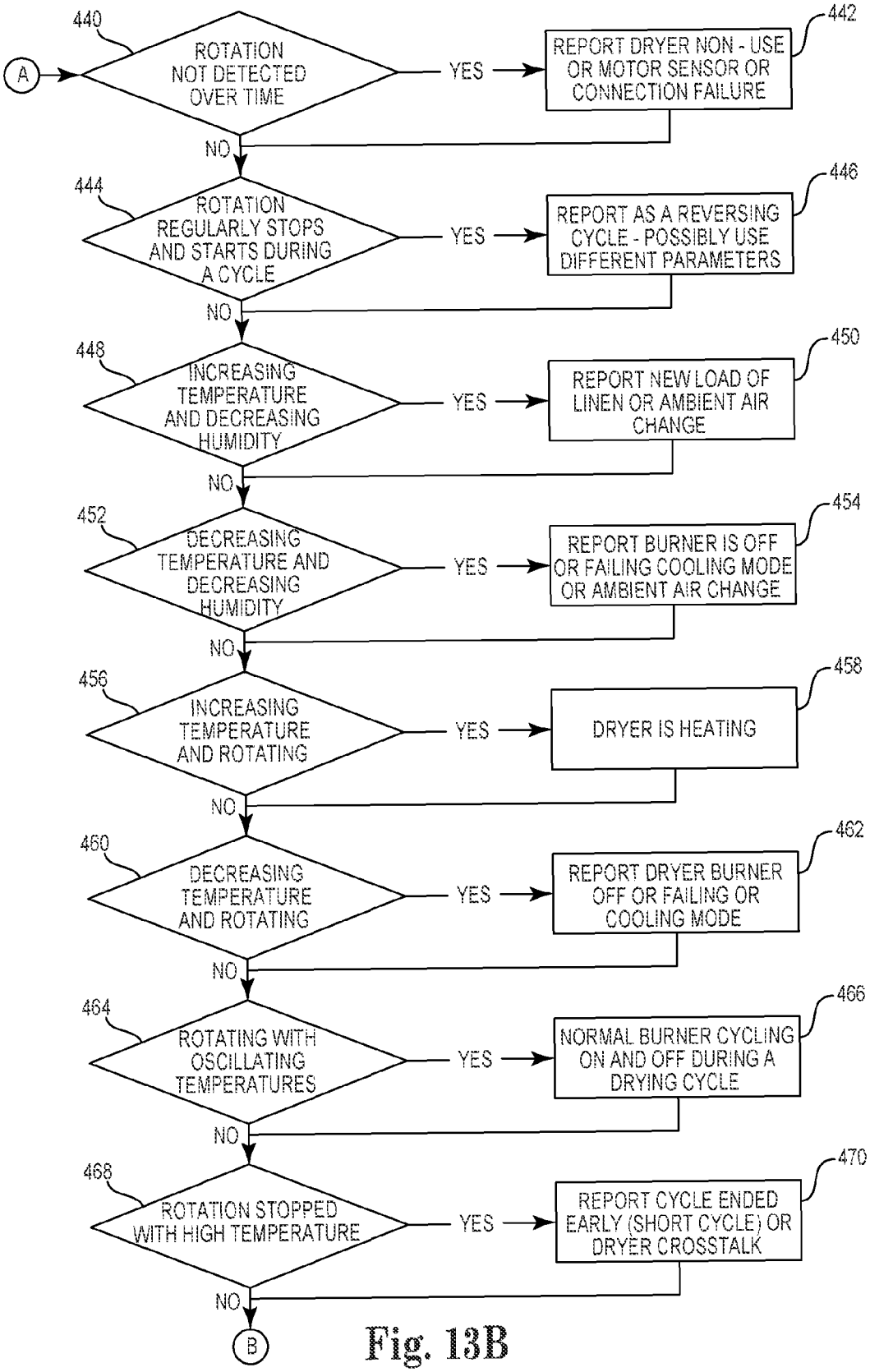
Figure 13C:
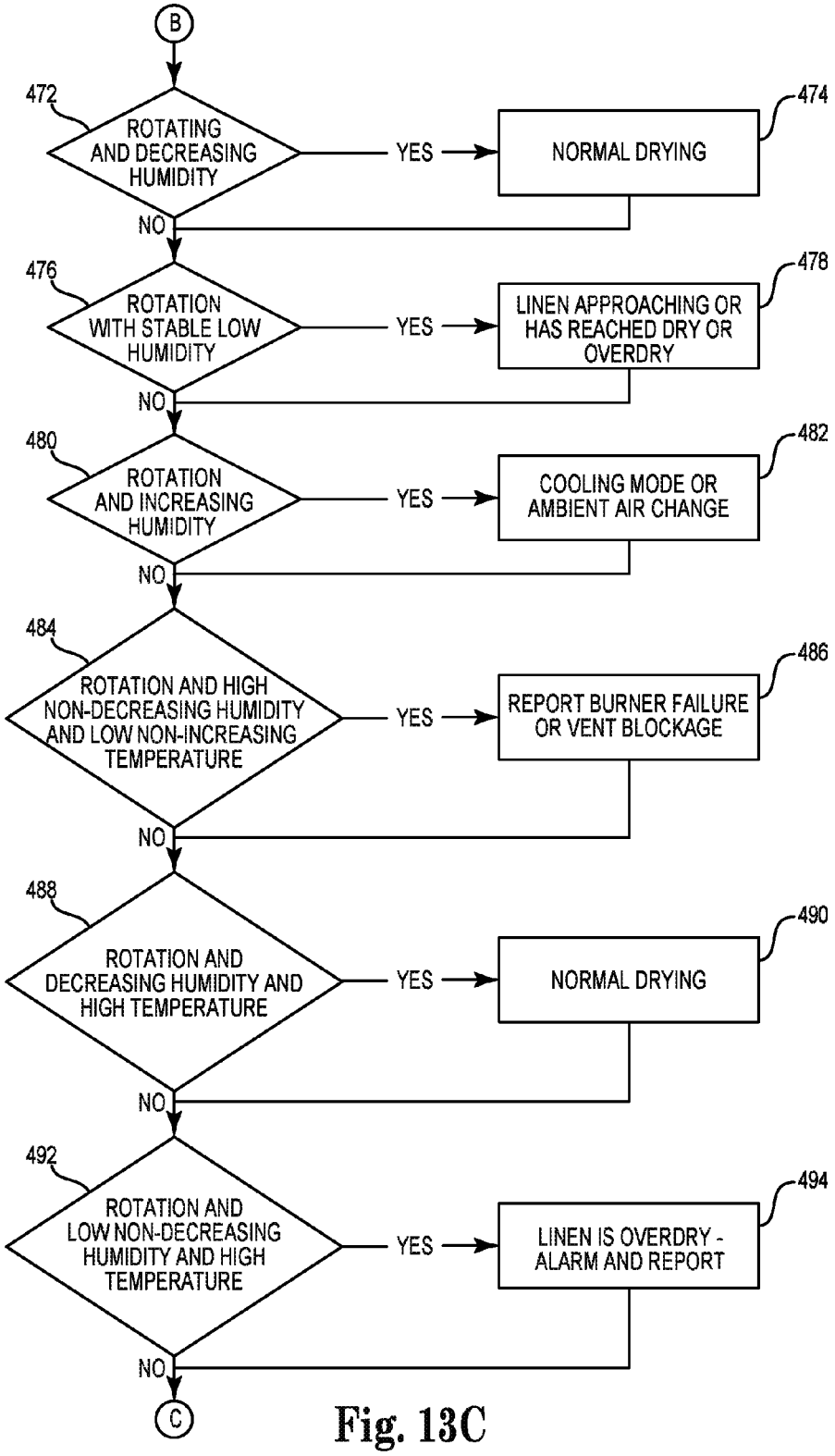
Figure 13D:
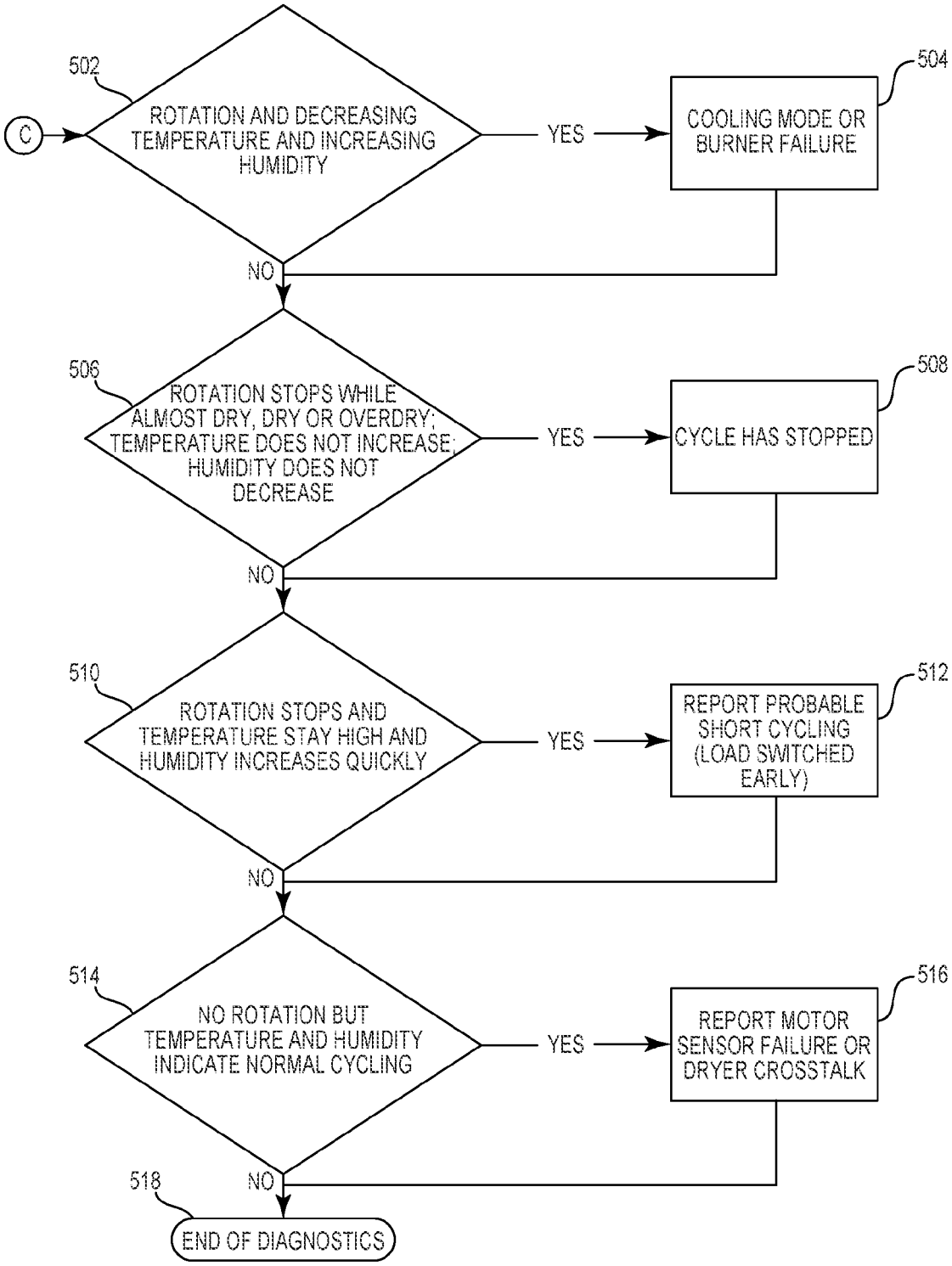

FIG. 12 is a graph of an example dryer cycle, showing graphs of the dryer temperature 370 and relative humidity 371 over the course of a dryer cycle. The y-axis represents the temperature (370) and relative humidity (371) information obtained by the temperature and humidity sensors, respectively, and the x-axis represents the data points obtained over time during the course of the dryer cycle.

In general, the temperature in a dryer is expected reach a certain point (based on historical data) within a certain amount of time. This is shown in FIG. 12 by the generally rising temperature indicated by reference numeral 372. If the temperature does not reach the expected temperature within the expected amount of time, this may be due to a faulty component(s), such as the gas burner valve, pilot ignition light, pilot ignition light thermocouple, or the gas burner itself. The temperature in the dryer should reach a certain peak temperature (based on historical data) and then begin cycling on and off (as indicated generally by reference numeral 374). This generally prevents the contents of the dryer from becoming too hot, which may potentially damage them. If the temperature continues to rise above what can be considered the normal peak temperature, there may be a problem such as failure of a temperature limit switch or failure of a temperature sensor. Peaks and valleys of the temperature during the cycling on and off of the burner (such as during time 374) may also be monitored. For example, if the time period between each successive peak and or valley fall out of an expected range (again, which may be based on historical data), system efficiency may be in question. There are multiple reasons in which this may occur. For example, the time period between the peaks may be longer than normal. For example, the burner may not operating efficiently, taking too long to heat between cycles; lint may be causing poor air flow through dryer; there may be poor air flow through dryer for other reasons; it may be taking longer than normal for upper temperature limit to be realized, upper limit switch may be failing; it may be taking longer than normal for lower temperature limit to be realized, lower limit switch may be failing; the burner may be "bad", which could be a carbon monoxide issue; the time period between the peaks shorter than normal due to a small load or a leak, such as when the door is not shut properly.

Also, the dryer monitor may monitor one or more ambient conditions in the laundry. There may be some fine tuning of dryer temperatures/cycle times based on these conditions. In addition, high dryer temperatures can be affected by high ambient temperatures experienced in certain locations or during certain times of the year.

When a "normal" dryer cycle is complete, the temperature is generally expected to decrease in a certain amount of time, as indicated generally by reference numeral 376, for example. If the temperature stays higher than expected, as indicated by reference numeral 378, for example, there may be "crosstalk" affecting the temperature characteristics from other dryers in close proximity. For example, in some commercial or institutional laundry establishments, more than one dryer may share a venting system. Crosstalk may occur between dryer ducts of shared dryers, for example. This crosstalk may affect the information sensed by the dryer monitor and as such the dryer monitor may be able to detect situations where crosstalk may be an issue.

In general, the relative humidity 371 is generally expected to decrease over the course of the dryer cycle as the contents of the dryer become more dry. If the relative humidity does not decrease as expected within a given period of time (for example, the generally decreasing humidity indicated by reference numeral 382, for example) there may be insufficient water extraction, which can increase drying time. Or, there may be high ambient humidity in the room.

FIGS. 13A-13D are a flowchart illustrating an example process by which a dryer monitor may determine dryness of textiles in a dryer, determine whether the textiles are overdry, diagnose possible mechanical failures of various dryer components, identify ambient environmental conditions that may lead to inefficient drying, identify possible operator errors, and/or diagnose other dryer conditions that may be determined based on information received from one or more temperature, humidity, water content, dryer on/off, rotation, and/or other sensors.

Figure 14:
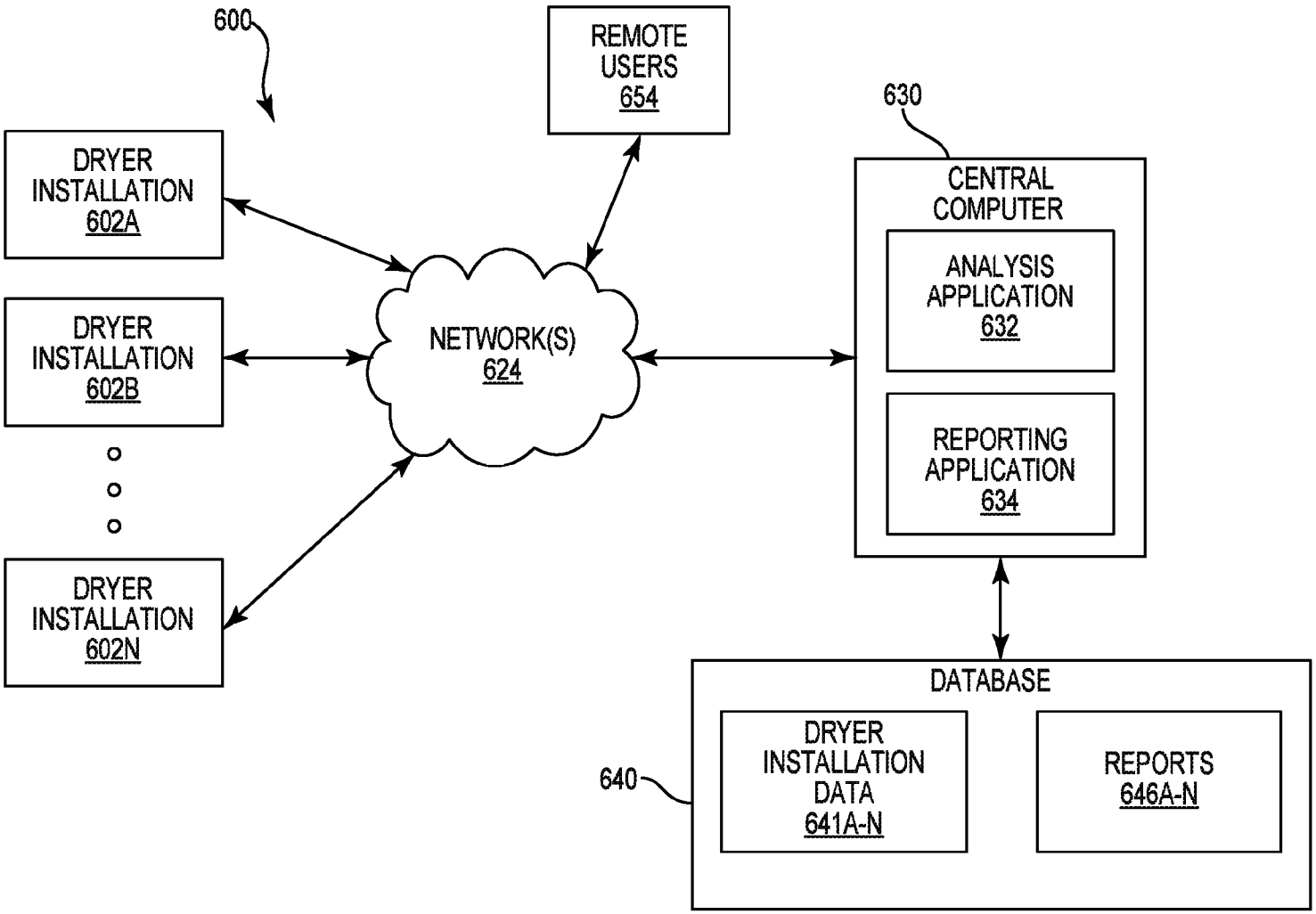
FIG. 14 is a block diagram illustrating an example communications environment within which the dryer monitor of the present disclosure may be used.

FIG. 14 is a block diagram illustrating an example communications environment 600 within which the dryer monitor of the present disclosure may be used. One or more dryer installations 602A-602N are coupled via network(s) 624 to central computer 630. Each dryer installation includes one or more dryers (such as dryer 2 of FIG. 1). One or more dryer monitors, such as dryer monitor 20, are each associated with one or more dryers. That is, each dryer monitor may receive dryer information from one or more dryers. Network(s) 24 may include, for example, one or more of a dial-up connection, a local area network (LAN), a wide area network (WAN), the internet, a cell phone network, satellite communication, or other means of electronic communication. Any communication within the system communication may be wired or wireless. Central computer 630 receives dryer data from each dryer installation. The dryer data may be received directly from the dryer monitor(s). Alternatively, one or more of the dryer monitors at each site may transmit its dryer information to a dryer hub, which in turn transmit the dryer data for the one or more dryers to the central computer 630. The dryer data may also be transmitted via one or more one or more local computers at a dryer installation site. Central computer 630 may also send commands, instructions, software updates, etc. to each dryer monitor or dryer installation via network(s) 624. Central computer 630 may receive data or otherwise communicate with the dryer monitors or dryer installations on a periodic basis, in real-time, upon request of central computer 630, upon request of a local computer at a dryer installation, upon request of an individual dryer monitor, and/or at any other appropriate time.

The dryer data received from each dryer installation 602A-602N, as well as other data associated with the operation of the dryer monitoring system, may be stored on a database 640. Database 640 may store, for example, dryer installation data 641A-641N associated with each of the dryer installation 602A-602N. Database 640 may also store reports 646A-646N associated with each of the dryer installations 602A-602N, respectively.

Central computer 630 includes an analysis application 632 that analyzes the dryer information received from each of the dryer installations 602A-602N and stores the results for each dryer installation 602A-602N in the database 640. Analysis application 632 may analyze the dryer information associated with each dryer installation (that is, dryer installation data 641A-641N) either alone or in various combinations to monitor dryer condition by individual dryer, type of dryer, individual dryer installation, type of dryer installation, across a group of selected dryer installations, by region, or by various other selected parameters.

A reporting application 634 generates a variety of reports that present the analyzed dryer installation information for use by the person(s) responsible for overseeing dryer activities at each installation 602A-602N. Reporting application 634 may generate a variety of reports to provide users local to each dryer installation 602A-602N or remote users 654 with both qualitative and quantitative data regarding dryer activity at their dryer installation or group of dryer installations, and/or to compare data over time to determine whether changes have occurred. Reporting application 634 may also allow users to benchmark dryer activity at multiple dryer installations. The reports may also provide diagnostic suggestions in the event that the analysis indicates that errors are occurring at a particular dryer or installation, that maintenance is in order, etc.

Reports 646A-646N associated with each dryer installation 602A-602N, respectively, may also be stored in database 640. Reports 646A-646N may be accessed by users local to each dryer installation 602A-602N or by remote users 654 over one or more network(s) 624. One or more of the reports 646A-646N may be downloaded and stored on a local dryer installation computer, user computer 654, other authorized computing device, printed out in hard copy or further communicated to others as desired.

As described above, each dryer monitor 20 (such as dryer monitor 20 of FIG. 3) may store the dryer data for that individual dryer monitor. In addition, one or more local dryer installation computers, databases, or other local computer(s), may also receive and store dryer data from the associated dryer installation. The local computer may also include local analysis and reporting applications such as those described above with respect to analysis and reporting applications 632 and 634, respectively. In that case, reports associated with that particular dryer installation may be generated and viewed locally, if desired. In another example, all analysis and reporting functions are carried out remotely at central computer 630, and reports may be viewed, downloaded, or otherwise obtained remotely. In other examples, some dryer installations 602 may include local storage and/or analysis and reporting functions while other dryer installations 602 rely on remote storage and/or analysis and reporting. Thus, certain examples of data storage, analysis, and reporting are described herein, it shall be understood that these storage, analysis, and reporting functions may also be carried out locally, remotely, or at some other location, and that the disclosure is not limited in this respect.

FIGS. 15A-15F illustrate example reports of dryer information that may be generated by the dryer monitor 20 or reporting application 634. The example reports may provide users the ability to view dryer information in a current period, for one or more previous historical periods, or for any other defined period of time. The reports may be generated for individual dryers, for some or all dryers at a selected dryer installation, for some or all dryers at a group of selected dryer installations, etc. In these example reports, five historical periods (periods 2 to 6) are shown. The reports may display the start and the end dates for the current period and for each of the 5 historical periods for the dryer information (such as shown in FIG. 15F. The example reports shown in FIGS. 15A-15F do not include any data; however, it shall be understood that the relevant data for each period, if available, would be shown in the reports. The example reports may also include diagnostic suggestions in the event that certain thresholds indicating possible errors and/or inefficiencies are exceeded.

FIG. 15A shows an example report 702 that provides a user the ability to view Total Dryer Cycles data for one or more dryer monitors associated with a laundry location or a group of laundry locations. The number of total dryer cycles per period may be defined as the total number of cycles ran per dryer within the given period, for example. Example report 702 may highlight the current period's total dryer cycle value in red if it exceeds set thresholds, such as 20% more or 20% less than the average of the previous 3 periods.

FIG. 15B shows an example report 704 that provides a user the ability to view Total Over Dry Cycles data for one or more dryer monitors associated with a laundry location or group of laundry locations. The number of total over dry cycles per period may be defined as the total number of over dry cycles ran per dryer within the given period, for example. Example report 704 may highlight the current period's total over dry cycle value in red if it exceeds set thresholds, such as 20% more or 20% less than the average of the previous 3 periods.

FIG. 15C shows an example report 706 that provide a user the ability to view Average Dry Time Per Load data for one or more dryer monitors associated with a laundry location or group of laundry locations. The Average Dry Time Per Load may be defined as [the total dry time per dryer within the given period]/[the total number of cycles ran per dryer within the given period], for example. Example report 706 may highlight the current period's Average Dry Time Per Load value in red if it exceeds set thresholds, such as 20% more or 20% less than the average of the previous 3 periods. Example report 706 also includes diagnostic suggestions (such as "Check the lint screen" "Check the burner" "Is the washer extracting efficiently") that may be included in the event that the set thresholds indicating possible errors and/or inefficiencies are exceeded.

FIG. 15D shows an example report 708 that provides a user the ability to view Total Overdry Time data for one or more dryer monitors associated with a laundry location or group of laundry locations. The Total Over Dry Time may be defined as the total over dry time per dryer within the given period, for example. Report 708 may highlight the current period's Total Over Dry Time value in red if it exceeds set thresholds, such as 20% more or 20% less than the average of the previous 3 periods. Example report 708 also includes diagnostic suggestions (such as "Train customer to shut off dryer") that may be included in the event that the set thresholds indicating possible errors and/or inefficiencies are exceeded.

FIG. 15E shows an example report 710 that provides a user the ability to view Average High Temperature/Dryer data for one or more dryer monitors associated with a laundry location or group of laundry locations. The Average High Temperature/Dryer may be defined as [the Sum of the highest dry temperature per day per dryer within the given period]/[total days within the given period], for example. Report 710 may highlight the current period's Average High Temperature/Dryer value in red if it exceeds set thresholds, such as 20% more or 20% less than the average of the previous 3 periods. Example report 710 also includes diagnostic suggestions (such as "Check the burner" "Can the dryer temp be adjusted?" and "Have the customer request maintenance service") that may be included in the event that the set thresholds indicating possible errors and/or inefficiencies are exceeded.

FIG. 15F shows an example report 712 that provides a user the ability to view Average Low Humidity/Dryer data for one or more dryer monitors associated with a laundry location or group of laundry locations. The Average Low Humidity/Dryer may be defined as [the Sum of the lowest humidity level per day per dryer within the given period]/[total days within the given period], for example. Report 712 may highlight the current period's Average Low Humidity/Dryer value in red if it exceeds set thresholds, such as 20% more or 20% less than the average of the previous 3 periods.

Similar reports may also be generated for any of the other dryer information, including information detected by the dryer sensors at the installation(s), information calculated by an analysis application, or other parameters described herein.

In some example, the dryer monitor may encompass one or more computer-readable media comprising instructions that cause a processor, such as microcontroller 30, to carry out the methods described above. A "computer-readable medium" includes but is not limited to read-only memory (ROM), random access memory (RAM), non-volatile random access memory (NVRAM), electrically erasable programmable read-only memory (EEPROM), flash memory a magnetic hard drive, a magnetic disk or a magnetic tape, a optical disk or magneto-optic disk, a holographic medium, or the like. The instructions may be implemented as one or more software modules, which may be executed by themselves or in combination with other software. A "computer-readable medium" may also comprise a carrier wave modulated or encoded to transfer the instructions over a transmission line or a wireless communication channel.

The instructions and the media are not necessarily associated with any particular computer or other apparatus, but may be carried out by various general-purpose or specialized machines. The instructions may be distributed among two or more media and may be executed by two or more machines. The machines may be coupled to one another directly, or may be coupled through a network, such as a local access network (LAN), or a global network such as the Internet.

The dryer monitor may also be embodied as one or more devices that include logic circuitry to carry out the functions or methods as described herein. The logic circuitry may include a processor that may be programmable for a general purpose or may be dedicated, such as microcontroller, a microprocessor, a Digital Signal Processor (DSP), an Application Specific Integrated Circuit (ASIC), a field programmable gate array (FPGA), and the like.

One or more of the techniques described herein may be partially or wholly executed in software. For example, a computer-readable medium may store or otherwise comprise computer-readable instructions, i.e., program code that can be executed by a processor to carry out one of more of the techniques described above.

Various examples have been described. These and other examples are within the scope of the following claims.

The invention claimed is:

1. A system comprising:

a plurality of dryer installations, each dryer installation including one or more clothes dryers;

a plurality of sensors, each of which detects dryer information associated with one of the clothes dryers at the dryer installations, wherein the dryer information includes temperature information, humidity information, and rotation information; and a central computer that receives the dryer information associated with each of the one or more clothes dryers, the controller further including:

an analysis application that analyzes the dryer information associated with at least one of the one or more clothes dryers and generates one or more dryer status conclusions for the at least one of the one or more clothes dryer based on the analysis, wherein the status conclusion indicates that items in the at least one of the one or more clothes dryer are overdry if the analysis identifies a dryer rotation, a non-decreasing dryer humidity that satisfies than a low humidity threshold and a dryer temperature that satisfies a high dryer temperature threshold; and a reporting application that generates reports based on the analysis.

2. The system of claim 1 wherein the dryer information comprises at least one of moisture content information, ambient condition information, and dryer on/off information for each of the one or more clothes dryers at the dryer installations.

3. The system of claim 1 wherein the analysis application analyzes temperature information and rotation information, and wherein the status conclusion indicates one or more of a possible dryer burner problem, a possible short cycle, a possible crosstalk between dryer vents, and a possible door not properly closed if the analysis identifies a dryer rotation and a decreasing dryer temperature.

4. The system of claim 1 wherein the analysis application analyzes humidity information and dryer rotation information associated with at least one of the clothes dryers, and wherein the status conclusion indicates a possible washer extraction inefficiency if the analysis application identifies a dryer rotation and a dryer humidity that satisfies a high humidity threshold.

5. The system of claim 1 wherein the analysis application analyzes temperature information, humidity information and rotation information, and wherein the status conclusion indicates of one or more of a possible burner failure or a possible incoming hot air blockage if the analysis application identifies a dryer rotation, a non-decreasing humidity that satisfies a high humidity threshold, and a non-increasing temperature that satisfies a low temperature threshold.

6. The system of claim 1 wherein the analysis application analyzes dryer information from a selected group of dryer installations.

7. The system of claim 1 wherein the reporting application generates reports concerning operation of the clothes dryers at a selected group of the dryer installations over a defined period of time.

8. A system comprising:

a plurality of clothes dryers;

a temperature sensor that senses temperature information associated with at least one of the plurality of clothes dryers;

a humidity sensor that senses humidity information associated with at least one of the plurality of clothes dryers;

a rotation sensor that senses rotation information associated with at least one of the plurality of clothes dryers; and a controller that receives the temperature, humidity, and rotation information from at least one of the plurality of clothes dryers, the controller further including:

an analysis application that analyzes the temperature, humidity, and rotation information and generates one or more dryer status conclusions based on the analysis, wherein the one or more dryer status conclusions indicate that items in the at least one of the plurality of clothes dryers are overdry if the analysis identifies a dryer rotation, a non-decreasing dryer humidity that satisfies a low humidity threshold and a dryer temperature that satisfies a high dryer temperature threshold; and a reporting application that generates reports based on the analysis.

9. The system of claim 8 wherein the dryer information further includes at least one of moisture content information, ambient condition information, and dryer on/off information.

10. The system of claim 8 wherein the analysis application analyzes the temperature information and rotation information from the at least one of the plurality of clothes dryers, wherein the status conclusion indicates one or more of a possible dryer burner problem, a possible short cycle, a possible crosstalk between dryer vents, and a possible door not properly closed if the analysis identifies a dryer rotation and a decreasing dryer temperature.

11. The system of claim 8 wherein the analysis application analyzes the humidity information and rotation information from the at least one of the plurality of clothes dryers, and wherein the status conclusion indicates a possible washer extraction inefficiency if the analysis application identifies a dryer rotation and a dryer humidity that satisfies a high humidity threshold.

12. The system of claim 8 wherein the analysis application analyzes the temperature information, humidity information and rotation information from the at least one of the plurality of clothes dryers, and wherein the status conclusion indicates one or more of a possible burner failure or a possible incoming hot air blockage if the analysis application identifies a dryer rotation, a non-decreasing humidity that satisfies a high humidity threshold, and a non-increasing temperature that satisfies a low temperature threshold.

13. The system of claim 8 wherein if the analysis identifies a dryer rotation, a slow rate of dryer humidity change and a high dryer temperature, the controller generates a status conclusion indicative of a possible full linen screen or a possible small load.

14. The system of claim 8 wherein the reporting application generates one or more of a total dryer cycle report, a total over dry cycle report, an average dry time per load report, a total over dry time report, an average high temperature report, and an average low humidity report.

15. The system of claim 8 wherein the reporting application generates a report including dryer information for one or more of the plurality of clothes dryers.

* * * * *